US006029021A

United States Patent [19]

Nishimura et al.

[11] Patent Number: 6,029,021

[45] Date of Patent: Feb. 22, 2000

[54] IMAGE FORMING APPARATUS HAVING AN ADAPTIVE MODE DENSITY CONTROL SYSTEM

[75] Inventors: Shigeki Nishimura; Kenji Obuchi; Haruhiko Okabe; Satoshi Shimizu; Tokio Mitsuda; Hideki Minami, all of Saitama, Japan

[73] Assignee: Fuji Xerox Co., Ltd., Tokyo, Japan

[21] Appl. No.: 08/993,315

[22] Filed: Dec. 18, 1997

[30] Foreign Application Priority Data

| | | | |
|---|---|---|---|
| Dec. 20, 1996 | [JP] | Japan | 8-355072 |
| Dec. 27, 1996 | [JP] | Japan | 8-358082 |
| Nov. 21, 1997 | [JP] | Japan | 9-337671 |

[51] Int. Cl.[7] ..... G03G 15/00

[52] U.S. Cl. ..... 399/49; 399/60

[58] Field of Search ..... 399/49, 60, 72, 399/61, 62, 53, 51

[56] References Cited

U.S. PATENT DOCUMENTS

| | | | |
|---|---|---|---|
| 4,466,731 | 8/1984 | Champion et al. | 399/60 |
| 4,519,695 | 5/1985 | Murai et al. | 399/60 |
| 4,619,522 | 10/1986 | Imai | 399/55 |
| 4,632,537 | 12/1986 | Imai | 399/29 |
| 4,870,460 | 9/1989 | Harada et al. | 399/49 |
| 5,293,198 | 3/1994 | Sawayama et al. | 399/49 |

FOREIGN PATENT DOCUMENTS

| | | |
|---|---|---|
| 57-104159 | 6/1982 | Japan . |
| 61-254961 | 11/1986 | Japan . |
| 2-39178 | 2/1990 | Japan . |
| 3-98064 | 4/1991 | Japan . |
| 4-152371 | 5/1992 | Japan . |
| 5-323791 | 12/1993 | Japan . |

*Primary Examiner*—Robert Beatty

*Attorney, Agent, or Firm*—Finnegan, Henderson, Farabow, Garrett & Dunner, L.L.P.

[57] ABSTRACT

An image forming system adopting a dual-component inversion developing system for forming on an image carrier a toner patch image used for detecting an image concentration and controlling an image forming condition such as toner concentration based on the concentration of the toner patch image. The image forming system includes a charge unit for uniformly charging a surface of the image carrier, a developing magnet roll supplied with a developing bias, and a patch forming unit for selecting voltage application conditions to the charge unit and the developing magnet roll so as to reverse the bias potential relationship between the developing magnet roll and a charge potential of the image carrier and forming a first toner patch image at a contrast potential between the charge potential of the image carrier and the bias potential.

5 Claims, 30 Drawing Sheets

IMAGE FORMING APPARATUS HAVING AN ADAPTIVE MODE DENSITY CONTROL SYSTEM

BACKGROUND OF THE INVENTION

1. Field of the Invention

This invention relates to an image forming system and in particular to an electrophotographic image forming system using a dual-component inversion developing system, such as a copier or a laser printer.

2. Description of the Related Art

With the electrophotographic image forming system such as a copier or a laser printer, it is not easy to always hold the image concentration constant because of characteristic variations of photoreceptors and developers and characteristic change of photoreceptors and developers accompanying change in the use environment of temperature, humidity, etc. For a full-color image formed by superimposing toners of multiple colors on each other, particularly it is difficult to stabilize the image concentration because the toner characteristics for each color affect the image concentration. For example, the photo sensitivity of a photoreceptor is degraded with time, thus if the toner concentration in a dual-component developer is optimum, the image concentration tends to lower with long-term use. Therefore, the toner amount is increased for recovering the image concentration; on the other hand, if the toner concentration exceeds the optimum value, image quality failures of fog, character crush, etc., are caused.

In view of the electrophotographic characteristics, hitherto, various improvement measures for stabilizing the image concentration have been proposed. For example, in image forming systems described in Japanese Patent Unexamined Publication Nos. Sho. 61-254961 and Hei. 3-98064, the surface potential of a photoreceptor is detected by a potential sensor (ESV) and charge and exposure conditions are controlled so as to converge the surface potential on a target value. The concentration of a concentration detection pattern (toner patch image) formed after the surface potential is thus made constant is detected by a concentration detection sensor and the toner amount to be supplied to a developing device is controlled based on the concentration detection result.

If the toner patch image is thus formed after the surface potential of the photoreceptor is set to the target value, the detected concentration information of the toner patch image is not affected by fluctuation of the photo sensitivity of the photoreceptor. That is, light and dark of the toner patch image provided from the concentration information accurately reflect the toner amount in the developer (toner concentration) and control of the toner supply amount is facilitated; resultantly, a desired image concentration can be reliably provided according to the charge and exposure conditions.

On the other hand, a system for controlling so as to stabilize the toner concentration in a developer to a certain degree for preventing the image quality failures from occurring is described, for example, in Japanese Patent Unexamined Publication No. Hei. 4-152371. The system comprises a toner concentration sensor installed in a developing device to hold the toner concentration constant. Controlling the toner amount to be supplied to the developer so as to make the toner concentration constant based on the detection result of the toner concentration sensor is a general technique adopted for stabilizing the toner concentration.

Hitherto, consumed toner has been sensed by a consumed toner sensor installed in a toner supply device to manage the toner amount in the toner supply device. However, in recent years, the number of sensors has been reduced, for example, by recognizing consumed toner when a signal indicating that the toner concentration lowered several consecutive times is output by the toner concentration sensor. To reduce the number of sensors, a detection system for counting the number of image dots and assuming that images of a predetermined amount have been formed and that the toner has been consumed if the number of image dots exceeds a certain value is proposed in Japanese Patent Unexamined Publication No. Hei. 2-39178.

However, the conventional systems involve the following problems: First, the method of controlling the toner supply amount based on the toner concentration detected by the toner concentration sensor cannot precisely control the toner supply amount if the toner charge amount changes due-to environmental fluctuation of temperature, humidity, etc., or degradation with time, because even if the toner concentration is optimum, when the toner charge amount changes due to degradation of carriers, the bonding strength of the toner and the carriers changes and the toner move amount onto the photoreceptor changes.

In the method of recognizing consumed toner when the toner concentration lowered several consecutive times, if processing of a large image amount of an image occurs, the concentration temporarily lowers, but in fact, sufficient toner may remain. Thus, the consecutive number of times the toner concentration has lowered or the concentration lowering level as the consumed toner determination criteria needs to be corrected, resulting in complicated control. Further, the method of counting the number of image dots and estimating the toner consumption amount contains a number of variables such that the relationship between the number of dots and the toner consumption amount depends on the image type; a practical problem remains unsolved.

According to the consideration results, it is desired that the system for holding the surface potential of the photoreceptor constant and then detecting the image concentration comprises the toner concentration sensor for detecting consumed toner. However, since the potential sensor and the toner concentration sensor are expensive, it is not adequate to apply a large number of sensors to a so-called low-speed machine; another problem that low-speed machine performance cannot be improved is caused.

On the other hand, as described above, the toner concentration of a dual-component developer, namely, the percentage of toner weight to total weight of toner and carriers, is extremely important on stabilizing the image quality. Although the toner of the developer is consumed, the carriers are not consumed, thus the toner concentration changes. Thus, an image forming system using a dual-component developer is provided with a developer concentration controller (ATR) for precisely predicting the toner consumption amount of the developer and replenishing toner in response to the predication result for always controlling the toner concentration constant.

FIG. 39 is a diagram to show the general configuration of a conventional digital printer having a developer concentration control function. An image data preparation device 101 supplies a pixel signal having an output level corresponding to the pixel concentration for each pixel to a pulse width modulation circuit 102. The pulse width modulation circuit 102 forms a laser drive pulse PR of width (duration) corresponding to the output level for each input pixel signal and outputs the laser drive pulse PR. That is, it forms a drive pulse of wider width in response to a high-concentration pixel signal, a drive pulse of narrower width in response to a low-concentration pixel signal, and a drive pulse of intermediate width in response to an intermediate-concentration pixel signal.

The laser drive pulse PR output from the pulse width modulation circuit 102 is supplied to a semiconductor laser 104 and causes the semiconductor laser 104 to emit light by the time corresponding to the pulse width. Therefore, the semiconductor laser 104 is driven for longer time for a high-concentration pixel and for shorter time for a low-concentration pixel. The laser light emitted from the semiconductor laser 104 is scanned in the horizontal scanning direction by a polygon mirror 114 and is applied through a reflection mirror 115 onto a photoreceptor drum 120 as an image carrier, forming an electrostatic latent image.

Electricity on the surface of the photoreceptor drum 120 is removed uniformly by an exposure device 118, then the surface is charged uniformly by a primary charger 117. Further, the surface of the photoreceptor drum 120 is irradiated with the laser light, forming an electrostatic latent image responsive to the image signal. The electrostatic latent image is developed to a visible image (toner image) by a developing device 111. The toner image is transferred by the action of a transfer charger 121 to a transfer material 123 held on a transfer belt 122 driven in the arrow direction by two rollers 113 and 124. The remaining toner left on the photoreceptor drum 120 is scraped out by a cleaner 119.

The output signal of the laser drive pulse PR output from the pulse width modulation circuit 102 is supplied to one input terminal of an AND gate 116 and a reference clock CLK is supplied to the other input terminal of the AND gate 116 from a reference clock source 125. Therefore, as many integration clock pulses Pa as the number corresponding to the pulse width Wn of the laser drive pulse PR, namely, as many clock pulses as the number corresponding to the concentration of each pixel are output from the AND gate 116, as shown in FIG. 40. A pulse accumulation device 103 integrates the number of integration clock pulses Pa for each pixel and sends the result to a CPU 106, which then converts the integration amount into a replenishment amount based on a data table entered in a RAM 105 and sends the replenishment amount to a motor drive circuit 107 as a toner replenishment signal. The motor drive circuit 107 drives a motor 108 by the time corresponding to the toner replenishment signal for turning a toner transport screw 110 in a toner replenishment tank 109 storing toner by the predetermined time for replenishing the developing device 111 with a proper amount of toner from the toner replenishment tank 109, thereby holding the concentration of the toner 112 in the developing device 111 constant.

In the conventional printer, the concentration of each pixel is converted into the pulse width of the laser drive pulse PR and the pulse width Wn is assumed to be the toner consumption amount to be counted by the reference clocks CLK. Thus, the concentration of each pixel and the toner amount predicted to be consumed to represent the pixel show a proportional relationship as indicated by dashed line A in FIG. 41.

In fact, however, toner is not attracted on an area where the latent image width is narrow (namely, the pulse width of the laser drive pulse PR is short), thus the toner consumption amount for the pixel concentration lessens. As the latent image width widens to some extent, toner is attracted reliably on the latent image, so that the pixel concentration and the toner consumption amount show a proportional relationship. Further, if the latent image width overwidens, the spacing between the latent image and the adjacent latent image becomes narrow and the latent images are made continuous, so that the toner consumption amount becomes constant regardless of the latent image width. Thus, the pixel concentration and the toner consumption amount actually show a nonlinear relationship like an S letter as indicated by solid line B in FIG. 41. Therefore, the conventional printer involves a problem that a large error occurs between the toner consumption amount predicted from the pixel concentration and the actual toner consumption amount.

Further, the laser drive pulse PR has a frequency of about 15 MHz. If an attempt is made to count the laser drive pulse PR with eight-time precision, 120-MHz reference clock is required. If peripheral circuitry is also made compatible with 120 MHz matching the reference clock, the circuit configuration becomes complicated and expensive.

SUMMARY OF THE INVENTION

It is an object of the invention to provide an image forming system that can maintain the image concentration constant with no image quality defects although the number of sensors is reduced and more particularly to an image forming system that can control the image concentration stably without using a very expensive ESV or toner concentration sensor and can also sense that toner has been consumed without using a consumed toner sensor.

It is another object of the invention to provide an image forming system that can execute analog addition of pixel concentration, thereby accurately predicting a toner consumption amount according to a simple and inexpensive configuration.

To the end, according to a first aspect of the invention, there is provided an image forming system adopting a dual-component inversion developing system for forming on an image carrier a toner patch image used for detecting an image concentration and controlling an image forming condition based on the concentration of the toner patch image, the image forming system comprising: charge means for uniformly charging a surface of the image carrier; a developing magnet roll for giving a bias potential to toner; and patch forming means for selecting voltage application conditions to the charge means and the developing magnet roll so as to reverse higher-than or lower-than relationship between a bias potential of the developing magnet roll and a charge potential of the image carrier at the time of normal image formation and forming a first toner patch image at a contrast potential between the charge potential of the image carrier and the bias potential.

According to a second aspect of the invention, there is provided an image forming system for developing an electrostatic latent image formed based on an image signal with a dual-component developer and transferring the developed image onto a transfer medium, the image forming system comprising: switching means being controlled in conduction by a pulse-width-modulated image signal; a power supply being connected to one end of the switching means; charge accumulation means being connected to the other end of the switching means and charged by the power supply when the switching means is placed into conduction; total charge amount detection means for finding a total amount of charges accumulated in the charge accumulation means; and prediction means for predicting a toner consumption amount based on the total amount of charge According to a third aspect of the invention, there is provided an image forming system for developing an electrostatic latent image formed based on an image signal with a dual-component developer and transferring the developed image onto a transfer medium, the image forming system comprising: first and second switching means being controlled in conduction by a pulse-width-modulated image signal; a switch for switching a target to be controlled in conduction by the image signal into either of the first and second switching means; a power supply being connected to one end of each of the first and second switching means; first charge accumulation means being connected to the other end of the first switching means and charged by the power supply when the first switching means is placed into conduction; second charge accumulation means being connected to the other end of the second switching means and charged by the power supply when the second switching means is placed into conduction; a reference voltage source for generating a reference voltage; first comparison means for comparing a terminal voltage of the first charge accumulation means with the reference voltage; second comparison means for comparing a terminal voltage of the second charge accumulation means with the reference voltage; a counter for counting the number of times the terminal voltage of each charge accumulation means has exceeded the reference voltage; first discharge means for discharging the first charge accumulation means when the terminal voltage of the first charge accumulation means exceeds the reference voltage; second discharge means for discharging the second charge accumulation means when the terminal voltage of the second charge accumulation means exceeds the reference voltage; and prediction means for predicting a toner consumption amount based on the count of the counter, wherein the switch switches the target to be controlled in conduction into the second switching means when the terminal voltage of the first charge accumulation means exceeds the reference voltage and switches the target to be controlled in conduction into the first switching means when the terminal voltage of the second charge accumulation means exceeds the reference voltage.

According to a fourth aspect of the invention, there is provided an image forming system for developing an electrostatic latent image formed based on an image signal with a dual-component developer and transferring the developed image onto a transfer medium, the image forming system comprising: first switching means being controlled in conduction by a pulse-width-modulated image signal; second switching means; a power supply being connected to one end of each of the first and second switching means; first charge accumulation means being connected to the other end of the first switching means and charged by the power supply when the first switching moans is placed into conduction; second charge accumulation means being connected to the other end of the second switching means and charged by the power supply when the second switching means is placed into conduction; a reference voltage source for generating a reference voltage; first comparison means for comparing a terminal voltage of the first charge accumulation means with the reference voltage; second comparison means for comparing a terminal voltage of the second charge accumulation means with the reference voltage; a counter for counting the number of times the terminal voltage of each charge accumulation means has exceeded the reference voltage; first discharge means for discharging the first charge accumulation means when the terminal voltage of the first charge accumulation means exceeds the reference voltage; second discharge means for discharging the second charge accumulation means when the terminal voltage of the second charge accumulation means exceeds the reference voltage; selective control means for performing conduction control selectively with the second switching means by an image signal input while the first charge accumulation means is discharged; and prediction means for predicting a toner consumption amount based on the count of the counter.

DETAILED DESCRIPTION OF THE PREFERRED EMBODIMENTS

Figure 2:
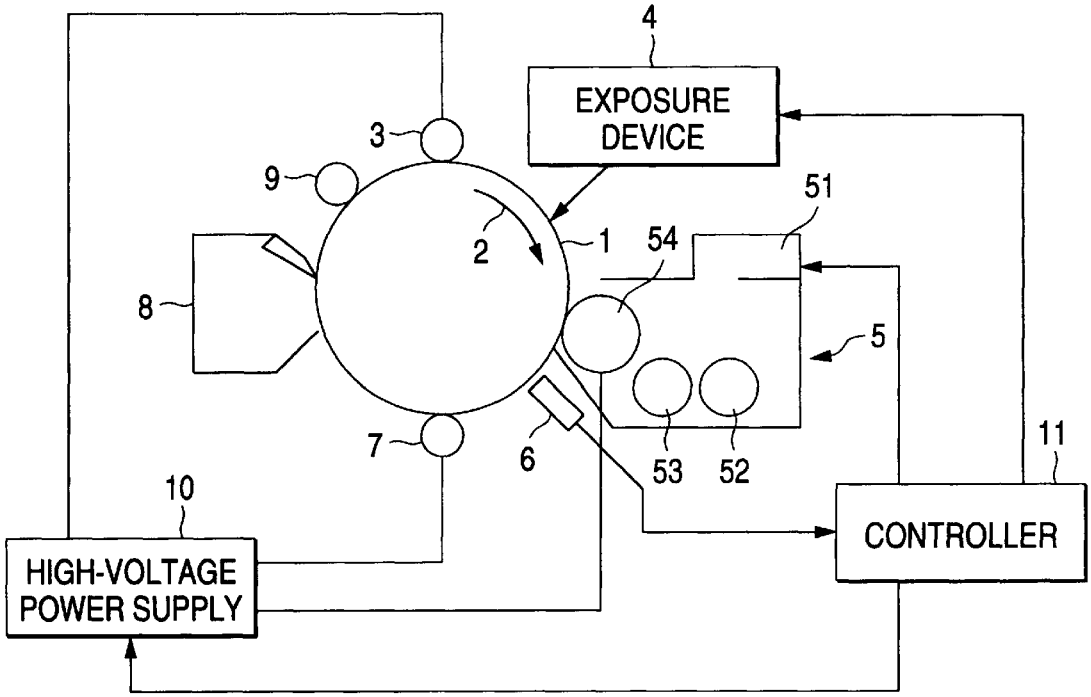
FIG. 2 is a block diagram to show the hardware configuration of the image forming system according to the first embodiment of the invention.

Referring now to the accompanying drawings, there are shown preferred embodiments of the invention. FIG. 2 is a block diagram of the main part of an image forming system according to a first embodiment of the invention. In the figure, a photoreceptor drum 1 as an image carrier (simply, photoreceptor) can be rotated in the direction of an arrow 2 by a motor (not shown). The photoreceptor 1 is surrounded by a charge roll (BCR) 3, an exposure device (ROS) 4, a developing device 5, a concentration sensor 6, a transfer roll (BTR) 7, a cleaner 8, and an erasure device 9. The developing device 5 comprises a toner supply device 51 placed on the upper portion thereof, an agitation roll 52 for agitating toner and carriers, a transport roll 53 for transporting a developer having carriers and toner mixed, and a developing magnet roll (simply, developing roll) 54 for giving a developing bias to the developer. A high-voltage power supply 10 for applying a charge voltage and developing bias is connected to the BCR 3, the BTR 7, and the developing roll 53. A corona discharger can be used in place of the BCR 3 or BTR 7.

The ROS 4, the toner supply device 51, the high-voltage power supply 10, and the concentration sensor 6 are connected to a controller 11. The controller 11 reads a concentration detection signal of a toner image detected by the concentration sensor 6, adjusts output and energization timing of the ROS 4 and the high-voltage power supply 10, and controls controls on and off of the toner supply device 51. It can be made up of an operation display section and a microcomputer containing a CPU, an ROM, an RAM, and a necessary input interface, which are not shown. The concentration sensor 6 can be made of a photo transistor adapted to detect the reflection strength of light output from a light emitting diode.

The image forming system having the above configuration forms an image as follows: First, a voltage is applied to the BRC 3 for negatively charging the surface of the photoreceptor 1 uniformly at a predetermined charge area potential (for example, −650 volts). Subsequently, the charged photoreceptor 1 is exposed by the ROS 4 so that the image area becomes at a predetermined exposure area potential (for example, −200 volts), forming a latent image. That is, the ROS 4 is turned on/off based on the image signal supplied from the controller 11, whereby the latent image corresponding to the image is formed.

Further, a developing bias (for example, −500 volts) is applied to the developing roll 54 of the developing device 5 and when the latent image is passed through the developing roll 54, it is developed with toner and is visualized as a toner image. This toner image is transferred to recording paper (not shown) by the BTR 7 and is supplied to a fixing section (not shown), then the resultant image is output. The remaining toner on the photoreceptor 1 is removed and collected by the cleaner 8. Finally, electricity of the photoreceptor 1 is eliminated or erased uniformly to about 0 volts by the erasure device 9 for the next image forming cycle.

A toner patch image for image concentration control is also formed by performing the same processing as the image formation except that it is formed in a different non-image forming cycle from the image forming cycle, that is, before and after the normal image formation, namely, between print it jobs or in an interimage in a print job. Control based on the detection result of the concentration sensor 6 will be discussed later in detail.

Figure 3:
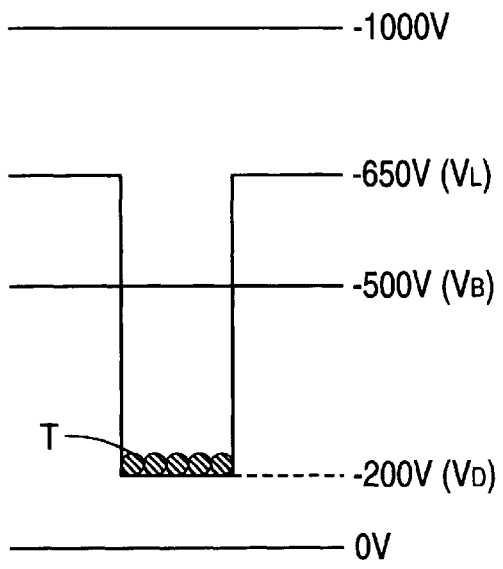
FIG. 3 is a schematic diagram to show potentials on a photoreceptor at the time of forming a point patch image.

FIG. 3 shows potential level examples on the photoreceptor 1 in the image forming operation. In the figure, when the photoreceptor 1 charged at −650-volt surface potential $V_L$ is irradiated with laser light modulated by the image signal, exposure area potential $V_D$ becomes −200 volts. Here, −500-volt developing bias $V_B$ is positioned between the surface potential $V_L$ and the exposure area potential $V_D$. Toner T, which is negatively charged, is moved from the developing roll 54 to the exposure area on the photoreceptor 1 in accordance with the difference between the exposure area potential $V_D$ and the developing bias $V_B$, namely, the contrast potential, and the image is developed. The toner patch image is also formed in accordance with a potential relationship similar to that in the image forming.

Figure 4:
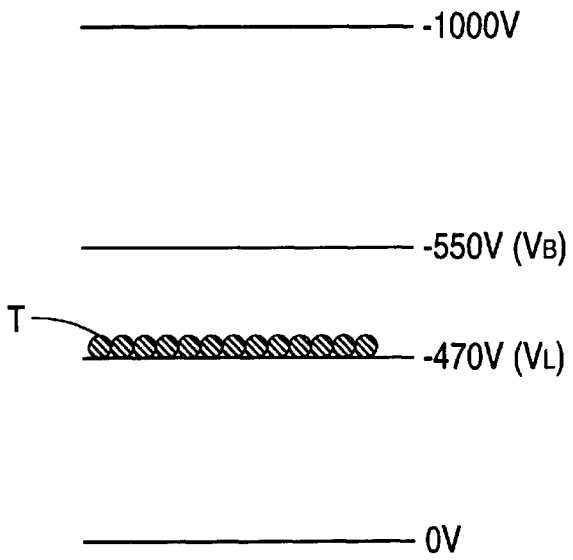
FIG. 4 is a schematic diagram to show potentials on the photoreceptor at the time of forming a band patch image.

In the embodiment, in addition to the toner patch image formed according to the potential condition similar to that of the image forming operation, which will be hereinafter referred to as "point patch image", another toner patch image, which will be hereinafter referred to as "band patch image", is formed under a different condition from the potential condition at the time of normal image formation. FIG. 4 is a schematic diagram to show potential level examples on the photoreceptor 1 at the time of band patch image formation. In the figure, the surface potential $V_L$ on the photoreceptor 1 is set to a level lower than that at the normal image formation time, namely, set to a level lower than the developing bias $V_B$ (for example, −470 volts). Toner is deposited on the area of the photoreceptor 1 charged at the lower level than the normal level in accordance with the contrast potential between the surface potential $V_L$ and the developing bias $V_B$ for developing an image as a band patch image.

The band patch image is thus formed only in accordance with the contrast potential between the surface potential $V_L$ and the developing bias $V_B$ without energizing the ROS 4. Like the point patch image, the band patch image is also formed in a non-image forming cycle. To form the band patch image, the BCR 3 is energized for uniformly charging the photoreceptor 1 at a lower level than that at the normal image forming time. The charge range is a range as long as the length of the BCR 3, namely, the entire width in the horizontal scanning direction and as long as a predetermined length in the rotation direction (process direction) of the photoreceptor 1.

Figure 5:
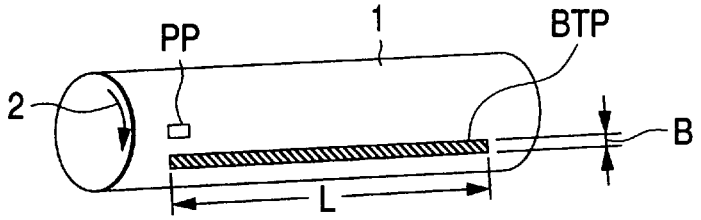
FIG. 5 is an illustration to show the shape of a toner patch image on the photoreceptor.

FIG. 5 shows an example of the band patch image In the figure, band patch image BTP is formed like a band having length B in the process direction and length L corresponding to the length of the BCR 3 in the scanning direction. FIG. 5 also shows point patch image PP formed under the conventional condition for comparison. In the embodiment, the relationship between the charge potential (surface potential) $V_L$ generated by the BCR 3 and the developing bias $V_B$ is thus set so as to become opposite to the conventional potential relationship and the band patch image is formed.

Since the band patch image BTP has the length L and extends over almost the whole of the length direction of the photoreceptor 1, the full length of a blade of the cleaner 8 is covered periodically with toner by the band patch image BTP. Resultantly, it can be expected that trouble of "curling" of the blade is corrected by the action of a cleaning assistant contained in the toner.

Figure 1:
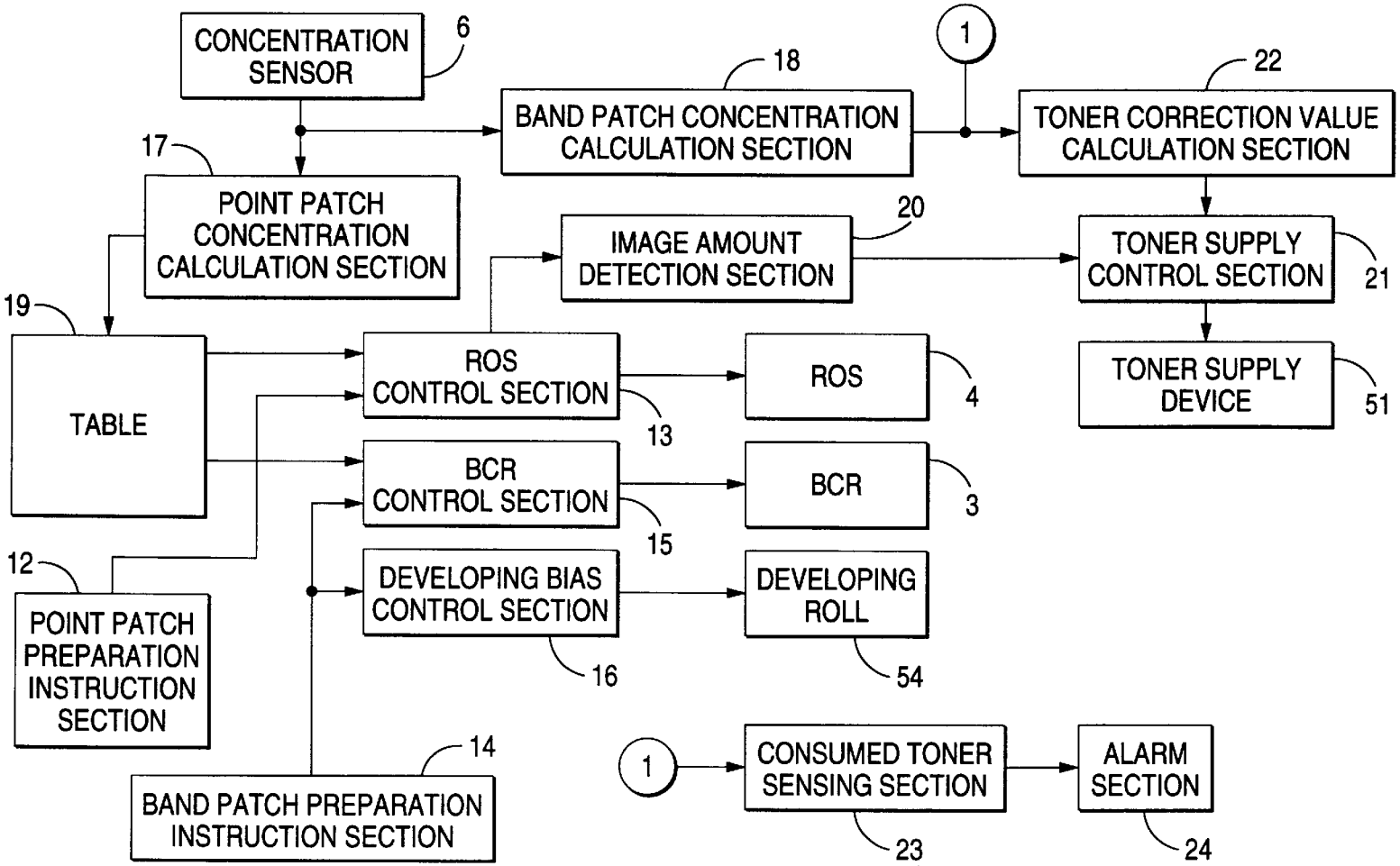
FIG. 1 is a block diagram to show the main part function of a controller of an image forming system according to a first embodiment of the invention.

Next, the main part function of the controller 11 will be discussed. FIG. 1 is a block diagram to show the main part function of the controller 11. In the figure, a point patch preparation instruction section 12 sends an instruction to a ROS control section 13 each time as many sheets as the preset number for point patch image formation are printed. Upon reception of the instruction, the ROS control section 13 turns on and off the ROS 4 for preparing the point patch image PP. A band patch preparation instruction section 14 sends an instruction to a BCR control section 15 and a developing bias control section 16 each time as many sheets as the preset number for band patch image formation are printed. The BCR control section 15 and the developing bias control section 16 control application voltages to the BCR 3 and the developing roll 54 as described with reference to FIG. 4 for preparing the band patch image BTP.

The concentration sensor 6 detects reflected light from the point patch image PP and the band patch image BTP and inputs detection signals to a point patch concentration calculation section 17 and a band patch concentration calculation section 18, which then calculate their corresponding patch image concentrations (patch concentrations) based on the signal levels supplied from the concentration sensor 6. To calculate the patch concentrations, the concentration on a clean face of the photoreceptor 1 (area where no toner is applied) is also referenced. A table 19 outputs an application voltage correction value of the BCR 3 and an output (LD light quantity) correction value of the ROS 4 with the point patch image concentration as an address to the BCR control section 15 and the ROS control section 13 respectively. A correction value for correcting output of the developing device 5, namely, a developing bias rather than the output correction of the BCR 3 and ROS 4 may be output.

An image amount detection section 20 detects the output time of the ROS 4 and sends the detection result to a toner supply control section 21 for calculating the toner supply time. The band patch concentration calculated by the band patch concentration calculation section 18 is input to a toner correction value calculation section 22, which then calculates the correction time and sends the correction time to the toner supply control section 21 for adding the correction time to the toner supply time. A motor of the toner supply device 51 is turned on and off in accordance with the toner supply time.

Further, the band patch concentration calculated by the band patch concentration calculation section 18 is input to a consumed toner sensing section 23, which then determines the band patch concentration change state and senses consumed toner. An alarm section 24 is energized in response to the consumed toner sensing result and gives an alarm indicating "consumed toner".

Figure 6:
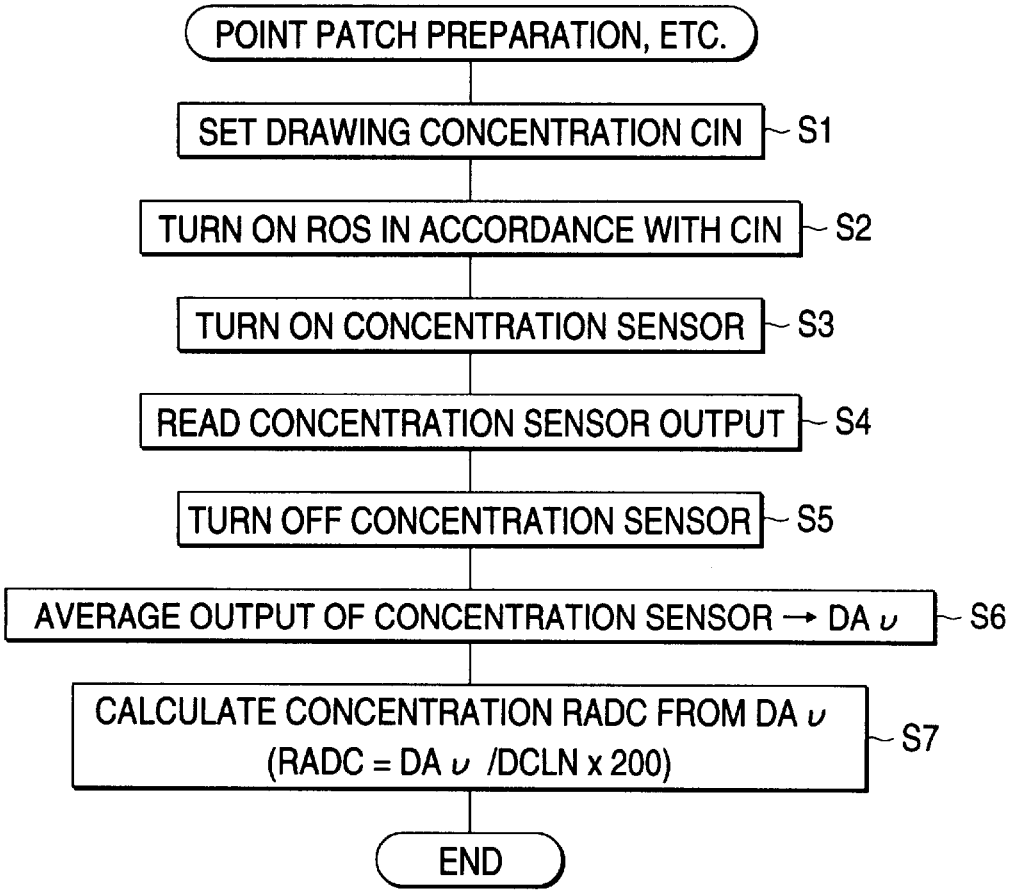
FIG. 6 is a flowchart of processing of point patch image preparation, etc.

Subsequently, processing of the controller 11 having the above function will be discussed in detail with reference to flowcharts. First, point patch image formation and concentration detection will be discussed. In FIG. 6, point patch image drawing concentration CIN is set at step S1. The drawing concentration CIN is represented by the area percentage of dots in the point patch image; for example, it is set to 50%. Although the drawing concentration CIN can be changed for preparing a number of patch images, one type is set in the embodiment. At step S2, the ROS 4 is driven in accordance with the drawing concentration CIN for forming a latent image of the point patch image PP on the photoreceptor 1. If the drawing concentration CIN is 50%, the ratio between the on-time and the off-time of the ROS 4 is 1:1. The point patch image written by the ROS 4 is developed by the developing device 5.

To measure the concentration of the developed point patch image PP, at step S3, after standby for the predetermined time, namely, when it is intended that the point patch image PP will arrive at the position of the concentration sensor 6, the concentration sensor 6 is turned on. At step S4, output of the concentration sensor 6 is read as many times as predetermined at the intended time intervals based on the expiration of the intended time between the instant at which the ROS 4 is turned on for the formation of point patch image PP and the instant at which the point patch image PP comes to the position opposed to the concentration sensor 6. In the embodiment, output of the concentration sensor 6 is read five times at 20-millisecond intervals, namely, five light and dark detection values are read. At step S5, the concentration sensor 6 is turned off.

At step S6, average value DAv of the read output values of the concentration sensor 6 is calculated. Here, to calculate the average value DAv, the maximum and minimum values of the five detection values are excluded. At step S7, concentration RADC of the point patch image PP is calculated based on the average value DAv. It is calculated based on the ratio between the detection value DAv of the point patch image PP provided by the concentration sensor 6 and a detection value of the photoreceptor 1 itself provided by the concentration sensor 6, namely, a detection value DCLN on a clean face where no toner is placed. A calculation expression example is shown in FIG. 6.

Figure 7:
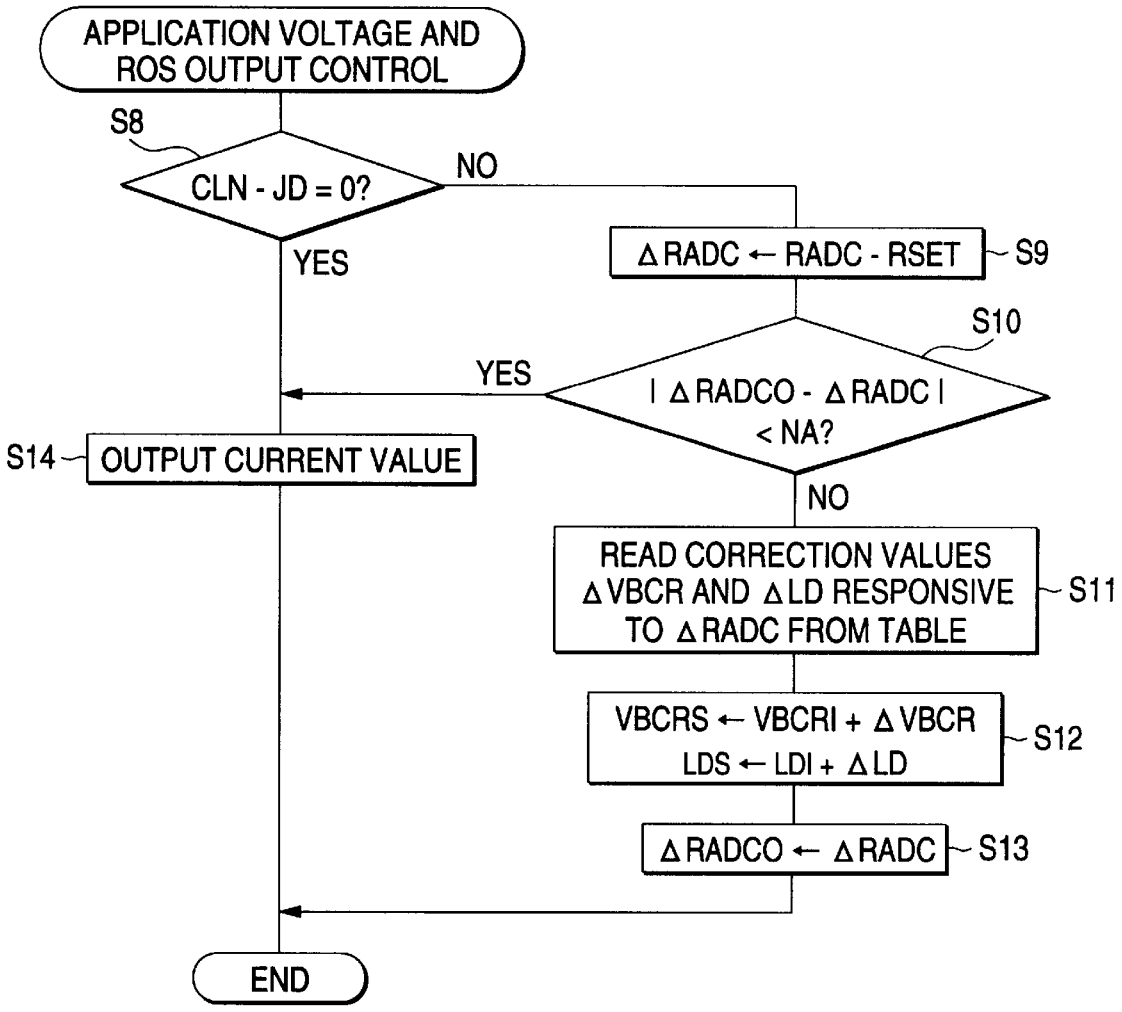
FIG. 7 is a flowchart of application voltage and ROS output control.

Next, BCR 3 application voltage and ROS 4 output control based on the concentration RADC will be discussed. In FIG. 7, at step S8, whether or not the concentration sensor 6 is much dirty is determined by whether or not a clean face judgement variable CLN-JD is "0". The judgement variable CLN-JD is a variable which is set to "0" when the clean face concentration is detected by performing processing similar to that in FIG. 6 and output of the concentration sensor 6 at that time falls below a predetermined dirt determination criterion value. When the variable CLN-JD is "0", namely, the concentration sensor 6 is much dirty, precise control cannot be performed. Therefore, in this case, control goes to step S14 and the previously calculated application voltage of the BCR 3 and output of the ROS 4, namely, the current value are output intact.

If output of the concentration sensor 6 is greater than the criterion value and the concentration sensor 6 is less dirty (CLN-JD=1), control goes from step S8 to step S9 and deviation ΔRADC of the concentration RADC of the point patch image PP from target concentration RSET is calculated. The deviation ΔRADC takes a positive or negative value. At step S10, whether or not the absolute deviation between previously detected deviation ΔRADC0 and the currently detected deviation ΔRADC is within a tolerance NA is determined. If the absolute deviation is within the tolerance, the detected concentration remains unchanged. Then, control goes to step S14 and the previous values are output as output of the BCR 3 and the ROS 4.

If the absolute deviation is beyond the tolerance, it is determined that the detected concentration has changed. Control goes to step S11 and the table 19 is searched for correction values ΔVBCR and ΔLD to correct the application voltage of the BCR 3 and the output of the ROS 4 responsive to the deviation ΔRADC. Two types of correction values corresponding to the positive and negative values of the deviation ΔRADC are set in the table 19.

At step S12, the correction values ΔVBCR and ΔLD are added to initial values VBCRI and LDI of the BCR 3 application voltage and ROS 4 output to calculate setup values VBCRS and LDS. If the values VBCRS and LDS are beyond the range of predetermined upper and lower limit values, they are clipped to the upper or lower limit values. At step S13, the currently detected deviation ΔRADC replaces the previous value ΔRADC0 for updating.

Figure 8:
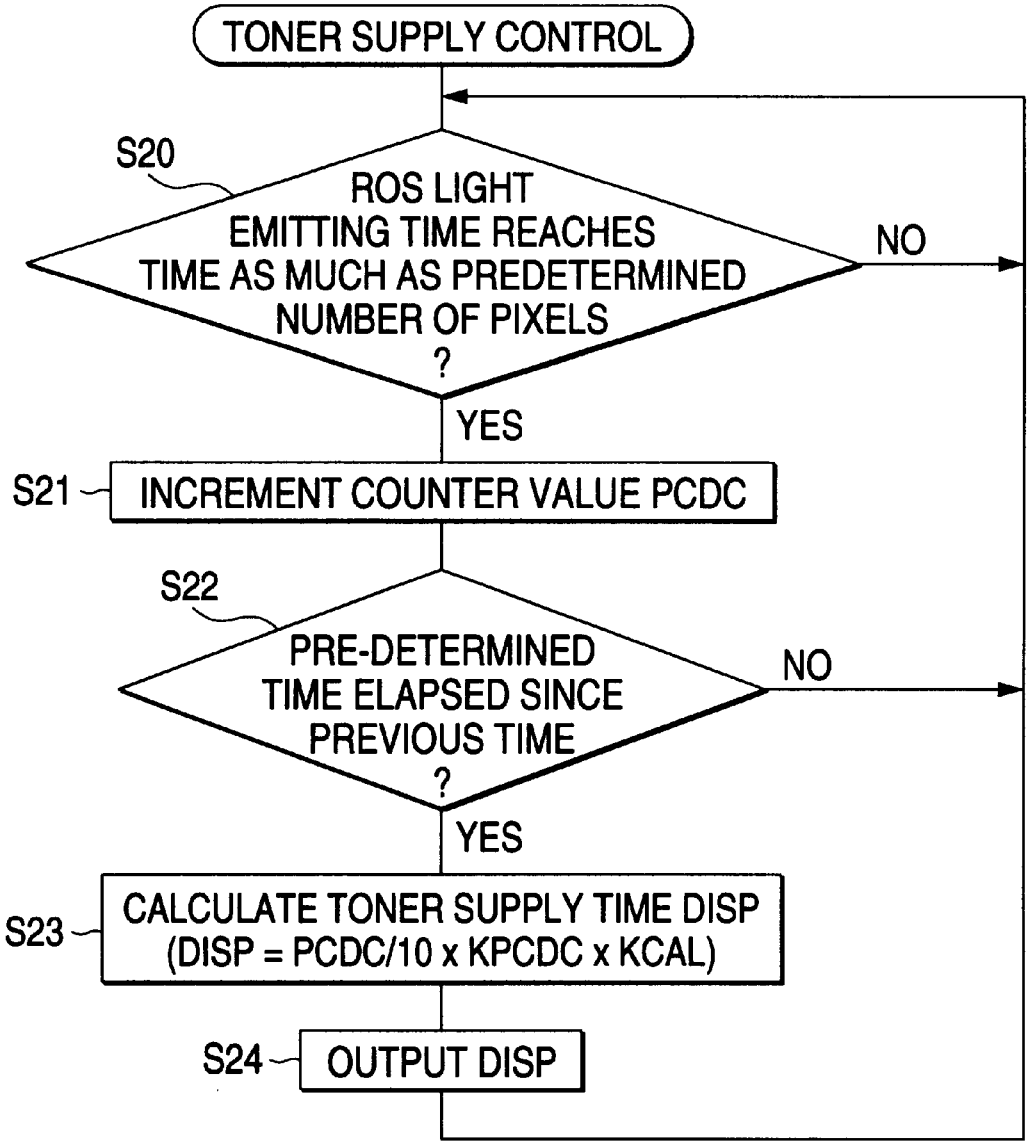
FIG. 8 is a flowchart of toner supply control.

The image forming system of the embodiment controls the toner supply amount based on the light emitting time of the ROS 4. That is, the image amount is estimated based on the light emitting time of the ROS 4 and toner as much as the toner consumption amount responsive to the estimation value is again supplied. Toner supply control responsive to the image amount will be discussed with reference to FIG. 8. In the figure, at step S20, whether or not the light emitting time of the ROS 4 reaches the time as much as the predetermined number of pixels (for example, 17000 pixels) is determined. If the number of pixels is reached, control goes to step S21 and counter value PCDC is incremented. At step S22, whether or not a predetermined time (for example, 500 milliseconds) has elapsed since the previous calculation is determined. If the time has elapsed, control goes to step S23 at which toner supply time DISP is calculated. An example of the calculation expression of the toner supply time DISP is shown in FIG. 8, wherein KPCD is a preset calculation coefficient and KCAL is a preset calibration coefficient. At step S24, the calculated toner supply time DISP is output to the toner supply control section 21, which then gives an instruction to the toner supply device 51 based on the time DISP.

Figure 9:
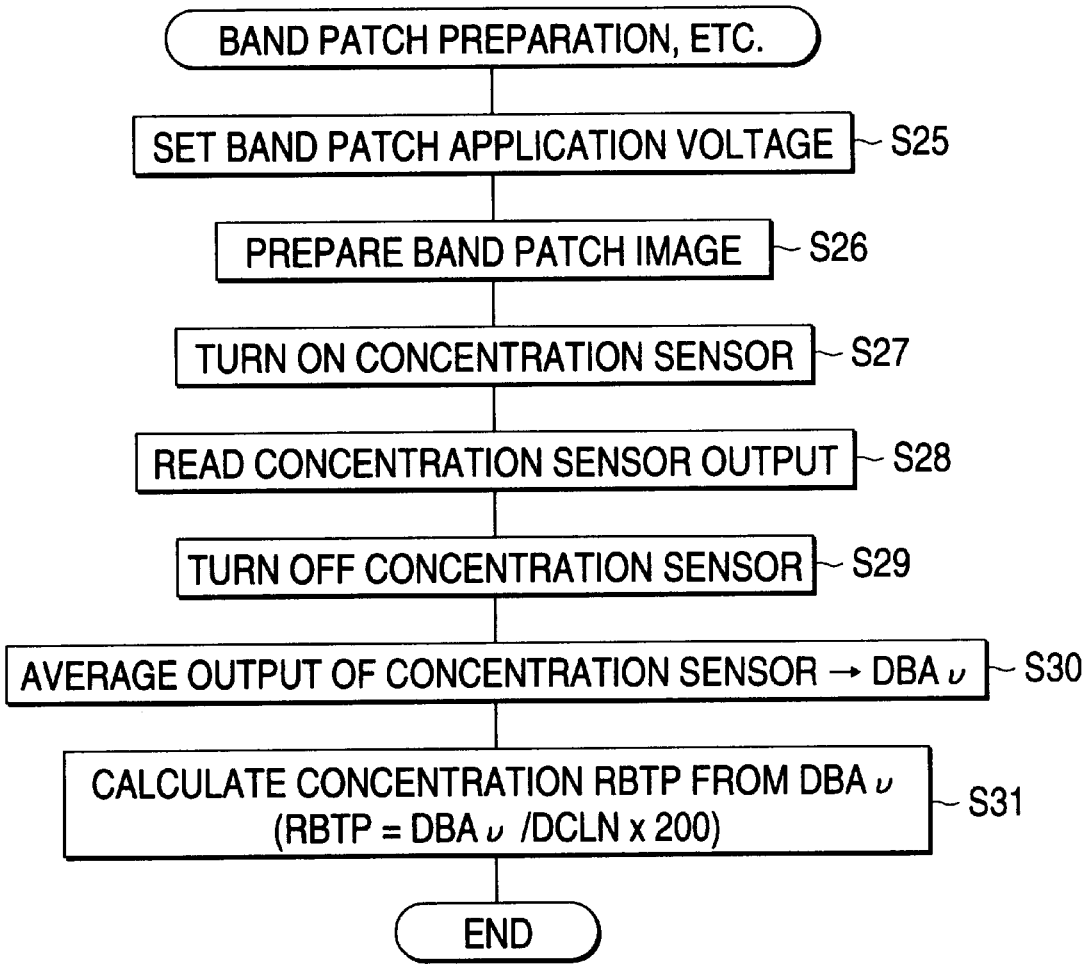
FIG. 9 is a flowchart of processing of band patch image preparation, etc.

In the embodiment, further the calculated toner supply time DISP is corrected based on the concentration of the band patch image BTP. Band patch image formation and concentration detection to correct the calculated toner supply time DISP will be discussed. In FIG. 9, at step S25, application voltages of the BCR 3 and the developing roll 54 are set in band patch image preparation values. Examples pf the application voltage values are shown in FIG. 4. At step S26, the photoreceptor 1 is charged according to the application value setup values, then toner developing is executed for forming band patch image BTP. To do this, the application voltages are changed from the normal values to the band patch image preparation setup values by the predetermined time corresponding to width B of the band pitch image.

At step S27, the concentration sensor 6 is turned on to measure the concentration of the developed band patch image BTP. At step S28, output of the concentration sensor 6 is read as many times as predetermined at the intended time intervals based on the expiration of the intended time between the instant at which the application voltage of the developing roll 54 is changed to the band patch image preparation setup value and the instant at which the band patch image BTP comes to the position opposed to the concentration sensor 6. In the embodiment, five detection values are read at 20-millisecond intervals as with the point patch image. At stop S29, the concentration sensor 6 is turned off. At step S30, average value DBAv of the read detection values of the concentration sensor 6 is calculated as with the point patch image. At step S31, band patch image concentration RBTP is calculated based on the average value DBAv. It is calculated based on the ratio between the value DBAv and detection value DCLN on a clean face of the photoreceptor 1 as with the point patch image.

Next, toner supply (correction) control based on the concentration measurement result of the band patch image will be discussed. As described with reference to FIG. 8, the toner supply time DISP is calculated based on the counter value PCDC every 500 milliseconds and toner supply amount control is performed based on the image amount. Here, further correction time DISP-TC of the toner supply time DISP is calculated based on the concentration of the band patch image each time a predetermined number of sheets (for example, 20) are printed.

Figure 10:
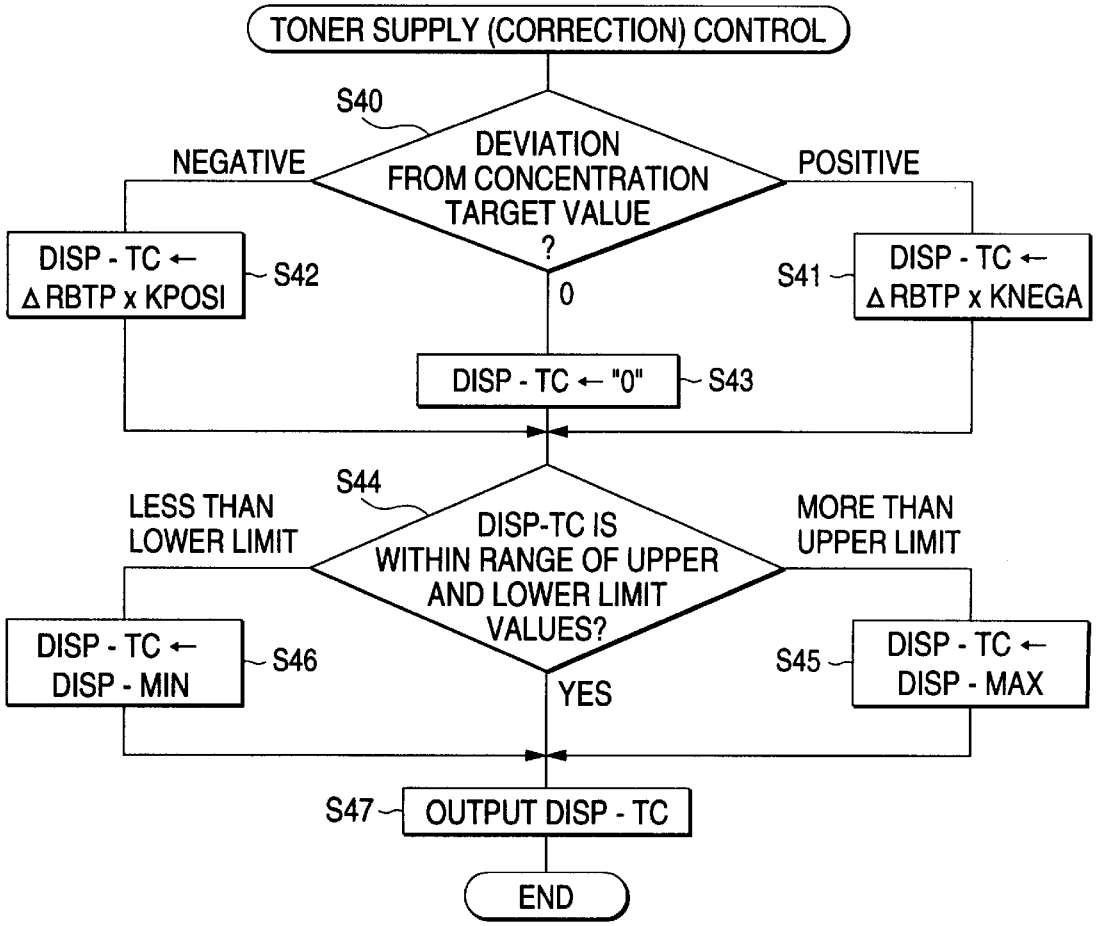
FIG. 10 is a flowchart of toner supply (correction) control.

In FIG. 10, at step S40, whether the value of (band patch image concentration RBTP—concentration target value RBTP—ADJ), namely, deviation ΔRBTP between the concentration RBTP and the concentration target value is positive, negative, or 0 (zero) is determined. If the deviation ΔRBTP is positive, control goes to step S41 and to decrease the toner supply time DISP, the concentration difference ΔRBTP is multiplied by a negative coefficient K-NEGA to calculate the correction time DISP-TC.

If the deviation ΔRBTP is negative, control goes to step S42 and to increase the toner supply time DISP, the concentration difference ΔRBTP is multiplied by a positive coefficient K-POSI to calculate the correction time DISP-TC. If the deviation ΔRBTP is 0, the toner supply time DISP need not be corrected. Then, control goes to step S43 and the correction time DISP-TC is set to 0. In the calculation of the correction time DISP-TC, if the concentration sensor 6 is very dirty, namely, if the variable CLNJD is 0, the correction time DISP-TC can also be set to 0 so that the toner supply time DISP is not changed.

At step S44, whether or not the correction time DISP-TC is within the range of upper and lower limit values is determined. If the time is within the range of upper and lower limit values, control goes to Step S47 and the correction time DISP-TC is output intact. On the other hand, if the correction time DISP-TC exceeds the upper limit value, control goes to step S45 at which the correction time DISP-TC is replaced with the upper limit value DISP-MAX; if the correction time DISP-TC falls below the lower limit value, control goes to step S46 at which the correction time DISP-TC is replaced with the lower limit value DISP-MIN. The updated correction time DISP-TC is output at step S47.

Subsequently, empty sensing control of the toner supply device based on the band patch image concentration RBTP will be discussed with reference to a flowchart of FIG. 11. Here, the band patch image concentration RBTP is compared with the previous value and if the concentration lowers, the counter value is incremented. When the counter value exceeds a threshold value, an alarm is given.

Figure 11:
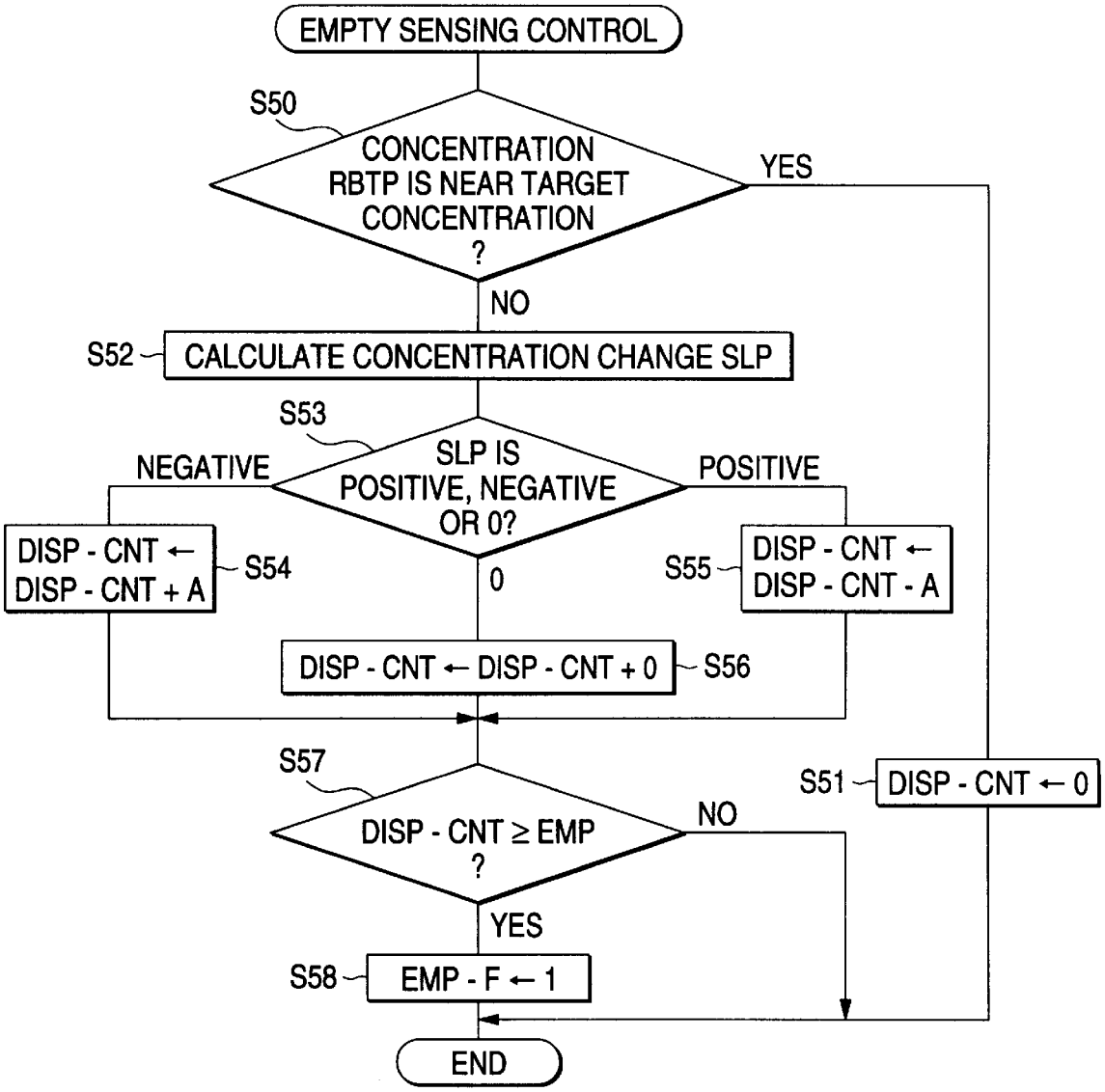
FIG. 11 is a flowchart of toner supply device empty sensing control.

In FIG. 11, at step S50, whether or not the concentration RBTP is near the target concentration, namely, within a predetermined range centering on the target concentration is determined. If the concentration RBTP is within the predetermined range, counter DISP-CNT is cleared at step S51. If the concentration RBTP is outside the predetermined range, control goes to step S52 and concentration change SLP is calculated. That is, the difference between the previous detected concentration RBTP0 and the currently detected concentration RBTP is calculated as the concentration change SLP.

At step S53, whether the concentration change SLP is positive, negative, or 0 (zero) is determined. If the concentration change SLP is negative, control goes to step S54 and the counter DISP-CNT is incremented by value A. The value A can be weighted in response to the value of the concentration change SLP. That is, the larger the concentration change SLP, the greater is the value A. On the other hand, if the concentration change SLP is positive, control goes to step S55 and the counter DISP-CNT is decremented by value A. The value A can also be weighted as when the concentration change SLP is negative. If the concentration change SLP is 0, control goes to step S56 and the counter DISP-CNT is held intact.

At step S57, whether or not the counter DISP-CNT has reached alarm criterion value EMP is determined. If the counter DISP-CNT reaches the value, control goes to step S58 and a flag EMP-F indicating that the storage means such as a tank or a cartridge of the toner supply device 51 is empty of toner is set. An alarm can be given based on the flag, for example, by displaying a message "Consumed Toner" on the display panel of the controller 11. The alarm may be alarm sound produced by a buzzer or the image forming system may be stopped at the same time as the alarm.

Figure 12:
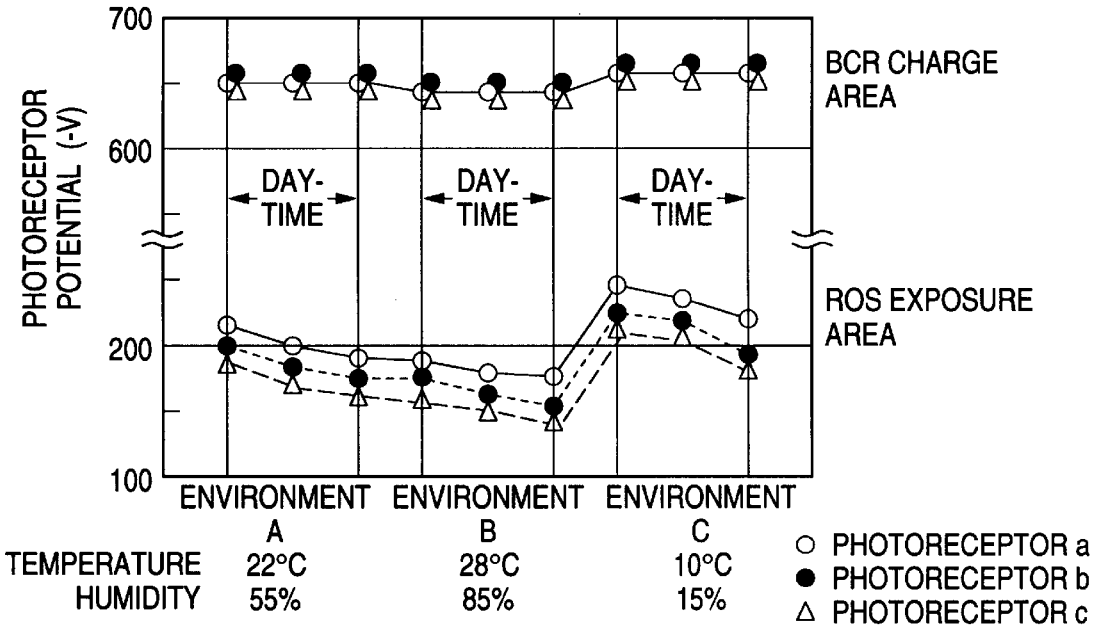
FIG. 12 is an illustration to show the relationship between photoreceptor potential and environment, etc.

Thus, in the embodiment, the toner patch image is formed without using exposure of the ROS 4 and control to hold the surface potential of the photoreceptor 1 constant is omitted. The reason why the image forming conditions can be controlled with high accuracy although the control is omitted is as follows: FIG. 12 is an illustration to show potential change of the photoreceptor. As shown here, the exposure area potential caused by the ROS 4 is largely affected by environmental fluctuation, daytime fluctuation, the individual difference between photoreceptors, etc. In contract, the charge area potential caused by the BCR is not affected by the environment, the individual difference between photoreceptors, etc., and is held almost constant. Therefore, it can be expected that the concentration of the band patch image formed in response to only the contrast of the charge potential caused by the BCR is not affected by change in the environment, etc., and is stable.

If the toner supply time is corrected based on the concentration of the band patch image, it can be assumed that the toner concentration is controlled constant. Therefore, in addition, if application voltage and ROS output control is performed based on the point patch imago concentration as shown in FIG. 7, a desired image concentration can be provided.

The embodiment relates to a monochromatic image forming system, but the invention is not limited to it and can also be applied to a color image forming system. The color image forming system may perform the above-described processing for each color.

As described above, the charge area potential caused by the BCR is affected a little by the environment, the individual difference between photoreceptors, etc. However, the developer charge amount (TV) varies with humidity change or the charge amount varies due to degradation of the developer. One possible cause of degradation of the developer is that an external additive added to toner is deposited on carriers.

Although charge area potential change with normal atmospheric temperature change is small, if the image forming system is run under an extreme high temperature environment, for example, is run continuously for a long time, heat generated by the image forming system accumulates, photoreceptor temperature extremely rises, and charge area potential tends to lower slightly. Further, since the photoreceptor wears out from long-term use, the BCR charge area potential also tends to lower slightly because of the wear.

Figure 13:
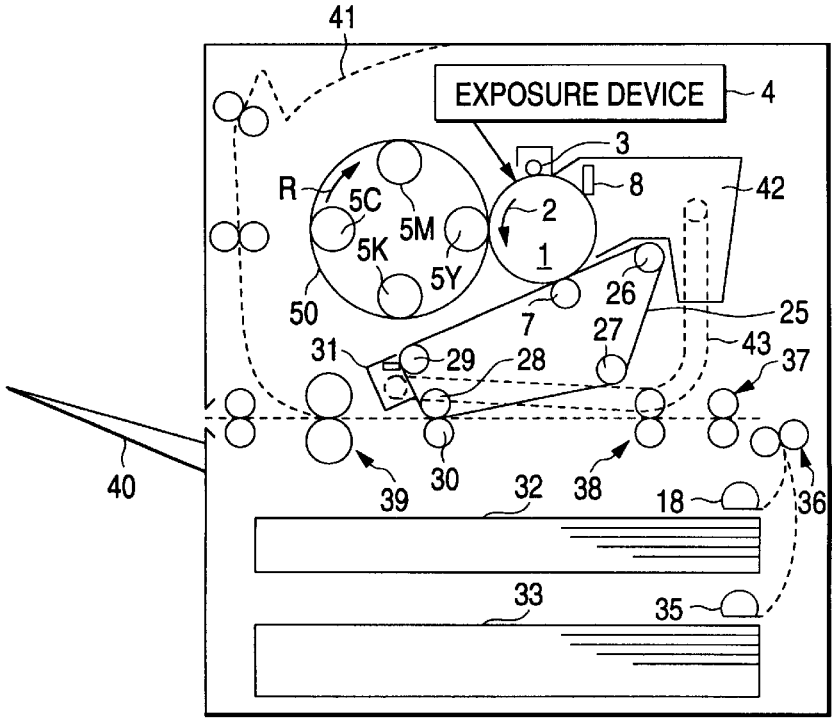
FIG. 13 is a diagram to show the hardware configuration of a full color image forming system.

Thus, the band patch image concentration cannot appropriately be maintained due to developer charge amount (TV) variation or BCR charge potential change associated with photoreceptor state change; resultantly, the toner concentration may be unable to be controlled to the optimum value. Then, the problem is solved and it is made possible to control image concentration furthermore accurately by performing correction control which will be described below:

For the correction control, an embodiment of the invention particularly assuming a full color image forming system (full color printer) will be discussed. First, the hardware configuration of the full color printer will be discussed. FIG. 13 is a diagram to show the main part of the full color printer. A developing device assembly 50 consists of four developing devices 5Y, 5M, 5C, and 5K for full color development. The developing devices 5Y, 5X, 5C, and 5K develop latent images on a photoreceptor 1 with yellow (Y), magenta (X), cyan (C), and black (K) toners respectively. To develop the images with the color toners, the developing device assembly 50 is rotated in the direction of the arrow by a motor (not shown) and the corresponding color developing device is controlled to the position opposed to the photoreceptor 1.

The four color toner images developed on the photoreceptor 1 are transferred to a belt 25 as an intermediate transfer body in order by a BTR (primary BTR) 7 and are superimposed on each other. The belt 25 is placed on rolls 26, 27, 28, and 29. The roll 26 is connected to a drive source and functions as a drive roll for driving the belt 25. The roll 27 functions as a tension roll for adjusting the tension of the belt 25. The roll 28 functions as a backup roll of a secondary BTR 30. A belt cleaner 31 is disposed at a position facing the roll 29 with the belt 25 therebetween for scraping out the remaining toner on the belt by means of a blade.

Recording paper drawn out from a recording paper cassette 32 or 33 to a transport passage by a drawing-out roll 34 or 35 is fed into a nip part, namely, an abutment part of the secondary BTR 30 and the belt 25 by roll pairs 36, 37, and 38. The toner image formed on the belt 25 is transferred on the recording paper at the nip part, is fused by a fuser 39, and is discharged to a tray 40 or a tray 41 at the top of the main body.

The waste toner scraped off from the photoreceptor 1 or the belt 25 is collected at a waste toner collection box 42. Particularly, waste toner collected by the belt cleaner 31 is transported through a pipe 43 to the waste toner collection box 42 by transport means such as an auger.

Figure 14:
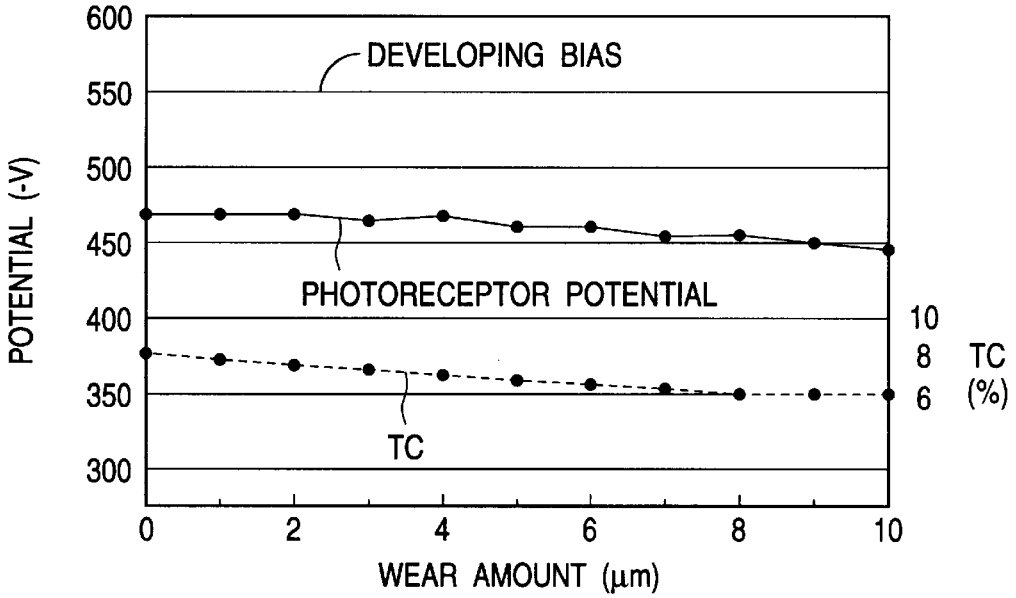
FIG. 14 is an illustration to show the relationship between photoreceptor wear amount and toner concentration.

The correction control in the full color printer having the above configuration will be discussed for each cause requiring a correction. First, the correction control responsive to the wear amount of the photoreceptor 1 will be discussed. FIG. 14 is an illustration to show charge area potential and toner concentration (TC) change corresponding to the wear amount of the photoreceptor 1. In the figure, the developing bias is stable at −550 V independently of the wear amount of the photoreceptor 1. However, the charge area potential of the photoreceptor 1 caused by the BCR 3 lowers as the wear amount increases. The contrast potential to form a band patch image grows as the charge area potential lowers. Resultantly, the band patch image concentration heightens and the developer toner concentration is controlled so as to lower; finally, the print image concentration lowers. Then, a correction is made for increasing application voltage of the BCR 3 in response to an increase in the wear amount.

Figure 15:
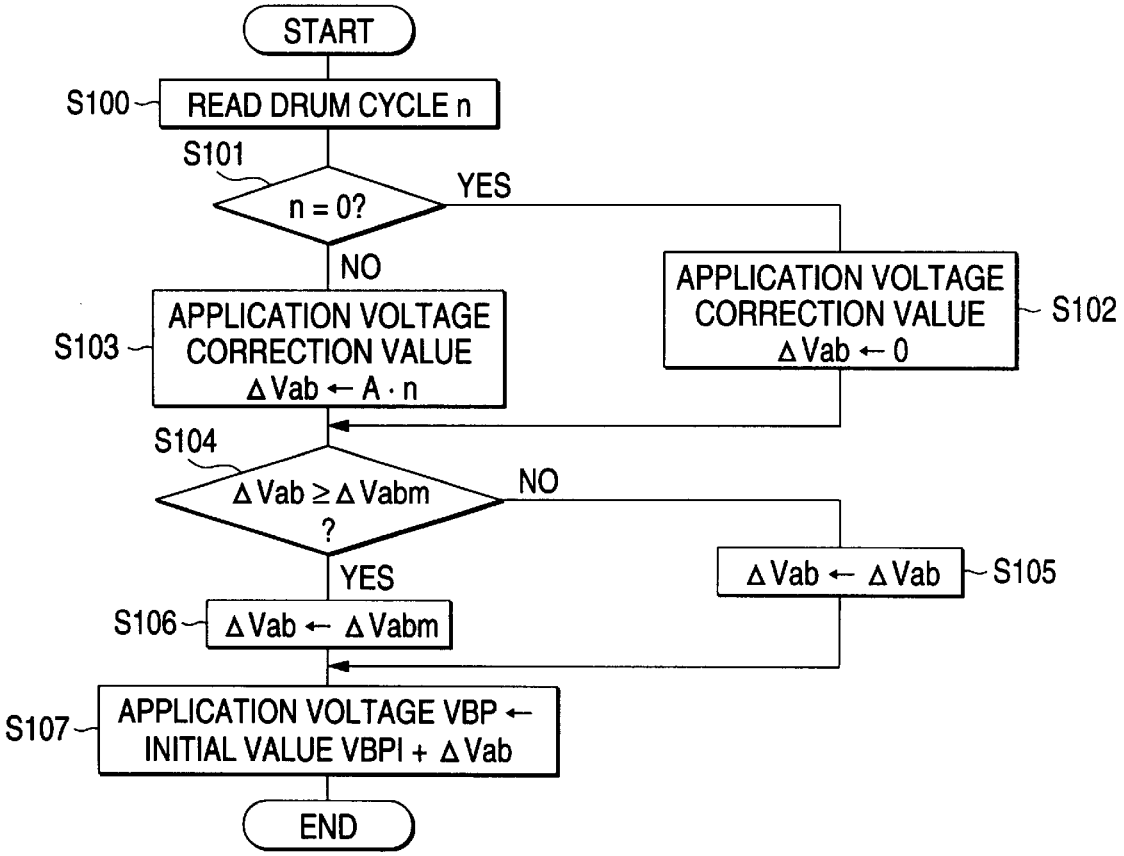
FIG. 15 is a flowchart for correcting application voltage in response to the photoreceptor wear amount.

FIG. 15 is a flowchart of control for increasing the application voltage of the BCR 3 in response to the wear amount of the photoreceptor 1. At step S100, the cumulative number of revolutions of the photoreceptor 1 (drum cycle), n, is read as a parameter representing the wear amount of the photoreceptor 1. At step S101, whether or not the drum cycle n is 0 (zero) is determined. Since the initial value of the drum cycle is 0, initially control goes to step S102 and band patch image application voltage correction value ΔVab of the BCR 3 is set to 0.

If the drum cycle n is not 0, control goes to step S103 and A·n is set as the correction value ΔVab. The constant A is a value predetermined based on an experimental value as the correction value ΔVab every drum cycle n. At step S104, whether or not the correction value ΔVab reaches upper limit value ΔVabm (for example, 10 volts) is determined. If the correction value ΔVab does not reach the upper limit value ΔVabm, control goes to step S105 and the correction value ΔVab is replaced with the value set at step S102 or S103. On the other hand, if the correction value ΔVab reaches the upper limit value ΔVabm at step S104, io control goes to step S106 and the correction value ΔVab is set to the upper limit value ΔVabm. That is, the correction value ΔVab is clipped at 10 volts. At step S107, the voltage resulting from adding the correction value ΔVab to initial value of band patch image application voltage, VBPI, is set as application voltage VBP of the BCR 3 for band patch image.

Figure 16:
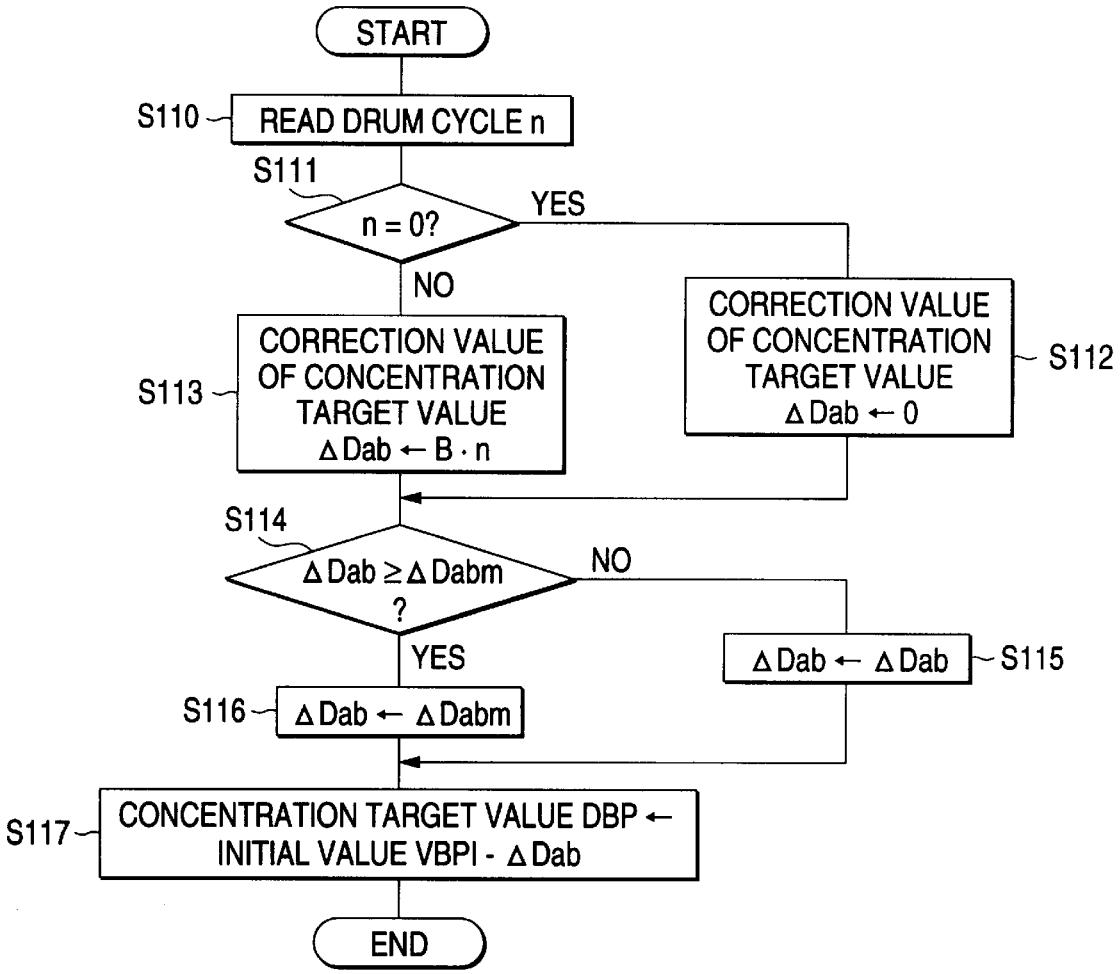
FIG. 16 is a flowchart for correcting a concentration target value in response to the photoreceptor wear amount.

The BCR application voltage is corrected in the correction control in FIG. 15. However, instead the band patch image target concentration may be controlled, for example. FIG. 16 is a flowchart of control for increasing the concentration target value of the BCR 3 in response to the wear amount of the photoreceptor 1. At step S110, the drum cycle of the photoreceptor 1, n, is read. At step S111, whether or not the drum cycle n is 0 (zero) is determined. Initially control goes to step S112 and concentration target value correction value ΔDab of the BCR 3 is set to 0.

If the drum cycle n is not 0, control goes to step S113 and B·n is set as the correction value ΔDab. The constant B is a value predetermined based on an experimental value as the correction value ΔDab every drum cycle n. At step S114, whether or not the correction value ΔDab reaches upper limit value ΔDabm is determined. If the correction value ΔDab does not reach the upper limit value ΔDabm, control goes to step S115 and the correction value ΔDab is replaced with the value set at step S113. On the other hand, if the correction value ΔDab reaches the upper limit value ΔDabm at step S114, control goes to step S116 and the correction value ΔDab is set to the upper limit value ΔDabm. That is, the correction value ΔDab is clipped at the upper limit value ΔDabm. At step S117, the value resulting from subtracting the correction value ΔDab from initial value of band patch image concentration, DBPI, is set as band patch image concentration target value DBP.

The drum cycle n can be made of a counter to be incremented each time the photoreceptor 1 makes 1000 revolutions, for example. In this case, the correction values ΔVab and ΔDab are updated each time the photoreceptor makes 1000 revolutions. The wear amount of the photoreceptor 1 can be represented by not only the drum cycle, but also the actual number of print sheets, the charge time of the BCR 3, or the like.

Figure 17:
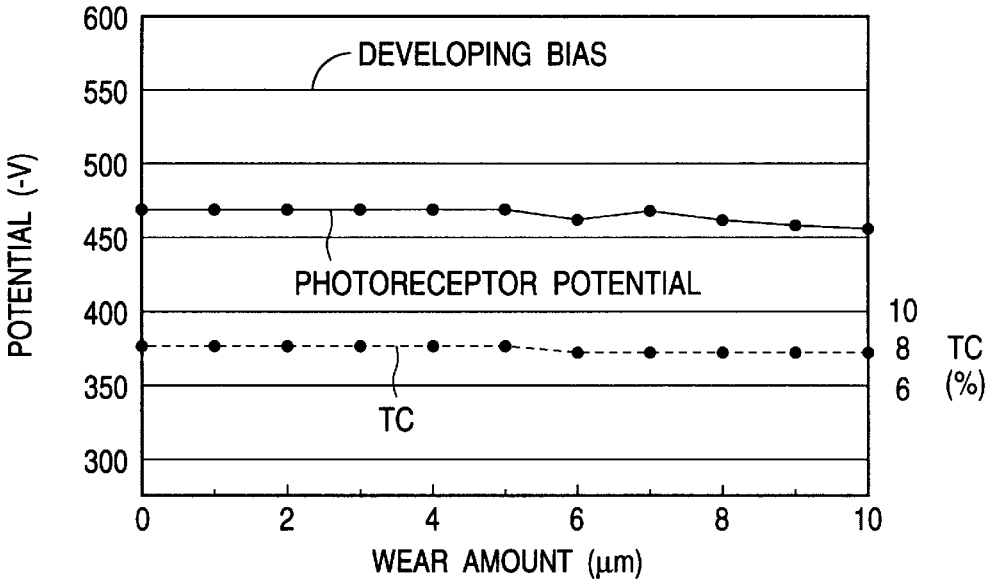
FIG. 17 is an illustration to show the relationship between photoreceptor wear amount and toner concentration after application voltage correction.

FIG. 17 is an illustration to show charge area potential and toner concentration (TC) change corresponding to the wear amount of the photoreceptor 1 after the application voltage or target concentration of the BCR 3 is corrected. As seen in the figure, although the wear of the photoreceptor 1 develops, the toner concentration is maintained almost constant.

The application voltage or target concentration of the BCR 3 is corrected in the above correction control. In addition, a similar effect can also be produced by lowering the application voltage to the developing device 5 when a band patch image is developed.

Figure 18:
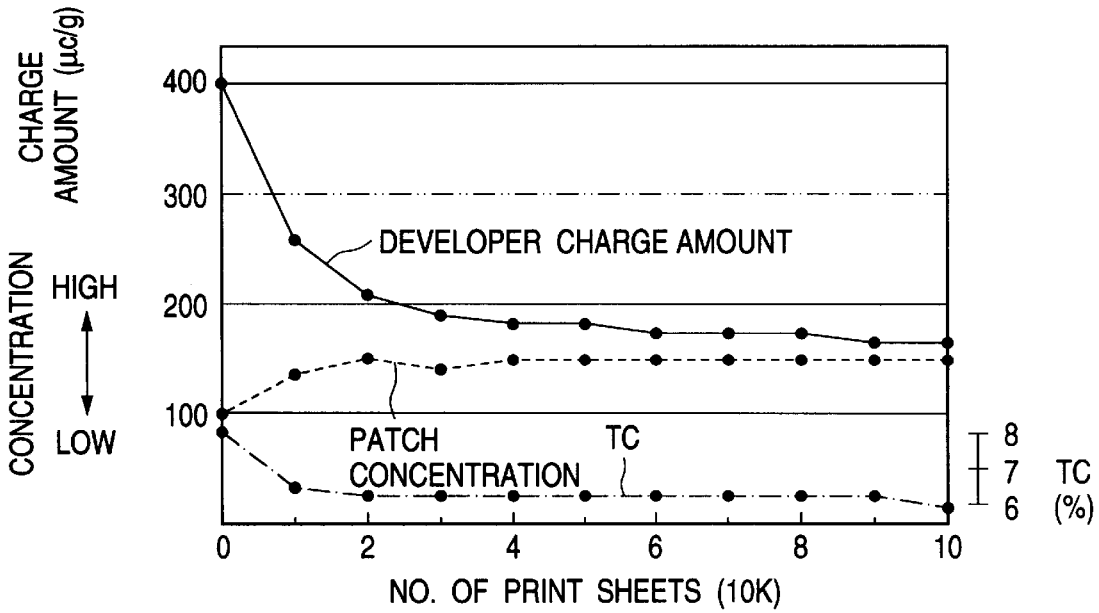
FIG. 18 is an illustration to show the relationship between the cumulative number of print sheets and toner concentration.

Next, the correction control responsive to lowering of the charge amount of a developer due to degradation of the developer will be discussed. FIG. 18 is an illustration to show changes of developer charge amount, band patch image concentration, and toner concentration (TC) in response to the number of print sheets. As shown here, the developer charge amount lowers, namely, the developer is degraded as the number of print sheets increases. Resultantly, the band patch image concentration heightens and the developer toner concentration is controlled so as to lower; finally, the print image concentration lowers. Then, in the embodiment, a correction in made for increasing the application voltage of the BCR 3 in association with an increase in the number of print sheets.

Figure 19:
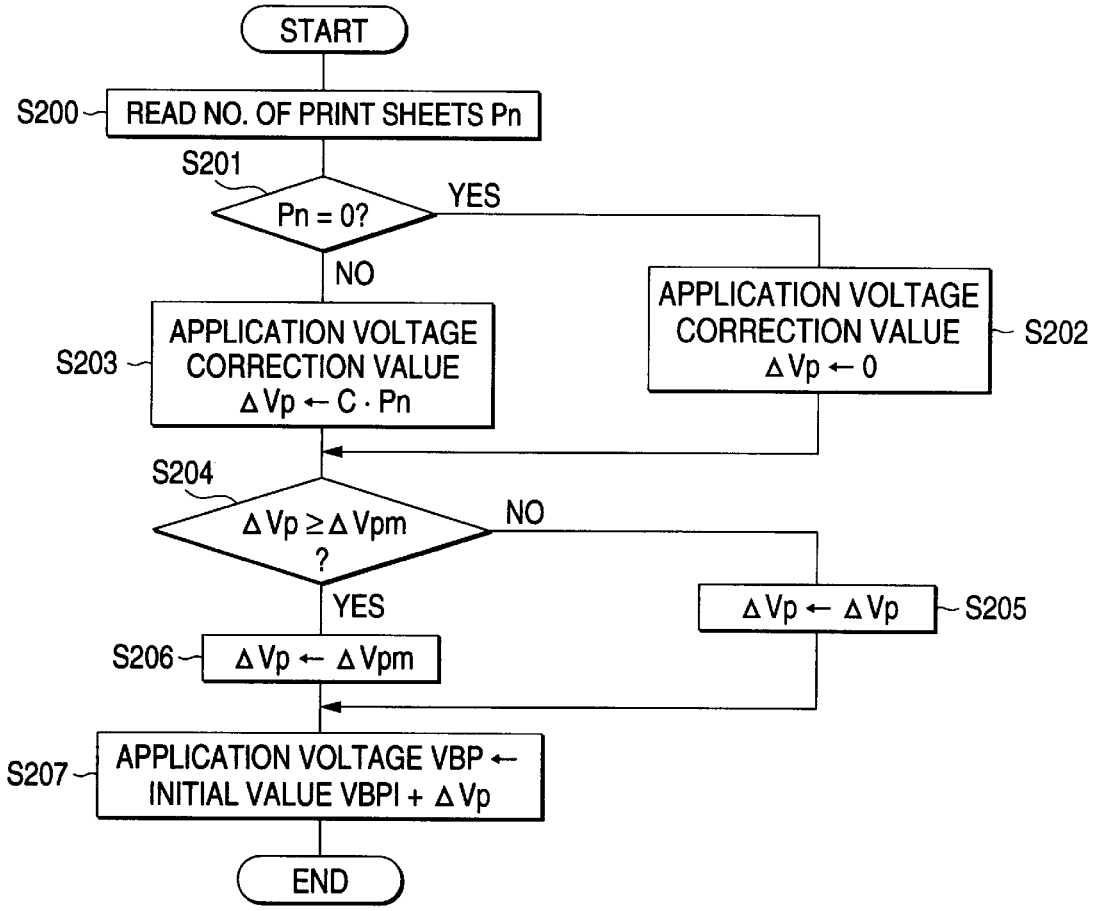
FIG. 19 is a flowchart for correcting application voltage in response to the cumulative number of print sheets.

FIG. 19 is a flowchart of control for increasing the application voltage of the BCR 3 in response to degradation of the developer. At step S200, the number of print sheets, Pn, is read as a parameter representing the degradation amount of the developer. At step S201, whether or not the number of print sheets, Pn, is 0 (zero) is determined. Since the initial value of the number of print sheets Pn is 0, initially control goes to step S202 and band patch image application voltage correction value of the BCR 3, ΔVp, is set to 0.

If the number of print sheets Pn is not 0, control goes to step S203 and C·Pn is set as the correction value ΔVp. The constant C is a value predetermined based on an experimental value as the correction value every number of print sheets Pn. At step S204, whether or not the correction value ΔVp reaches upper limit value ΔVpm (for example, 10 volts) is determined. If the correction value ΔVp does not reach the upper limit value ΔVpm, control goes to step S205 and the correction value ΔVp is replaced with the value set at step S202 or S203. On the other hand, if the correction value ΔVp reaches the upper limit value ΔVpm at step S204, control goes to step S206 and the correction value ΔVp is set to the upper limit value ΔVpm. That is, the correction value ΔVp is clipped at 10 volts as ΔVpm. At step S207, the voltage resulting from adding the correction value ΔVp to initial value of band patch image application voltage, VBPI, is set as the application voltage VBP of the BCR 3 for band patch image.

The number of print sheets Pn can be made of a counter to be incremented each time the number of print sheets is increased by 1000, for example. In this case, the correction values ΔVp is updated each time the number of print sheets is increased by 1000. The degradation amount of the developer can be represented by not only the number of print sheets, but also the number of revolutions of the developing roll 54, the developing bias application time, or the like. In the full color printer, the developing device assembly 50 is rotated matching the developing timings of the colors Y, M, C, and K and constant correspondence is established between the rotation time of the developing device assembly 50 and the developer degradation amount. Thus, the developer degradation amount can be represented by the on-time of a clutch connecting the motor for rotating the developing device assembly 50 and the developing device assembly 50.

Figure 20:
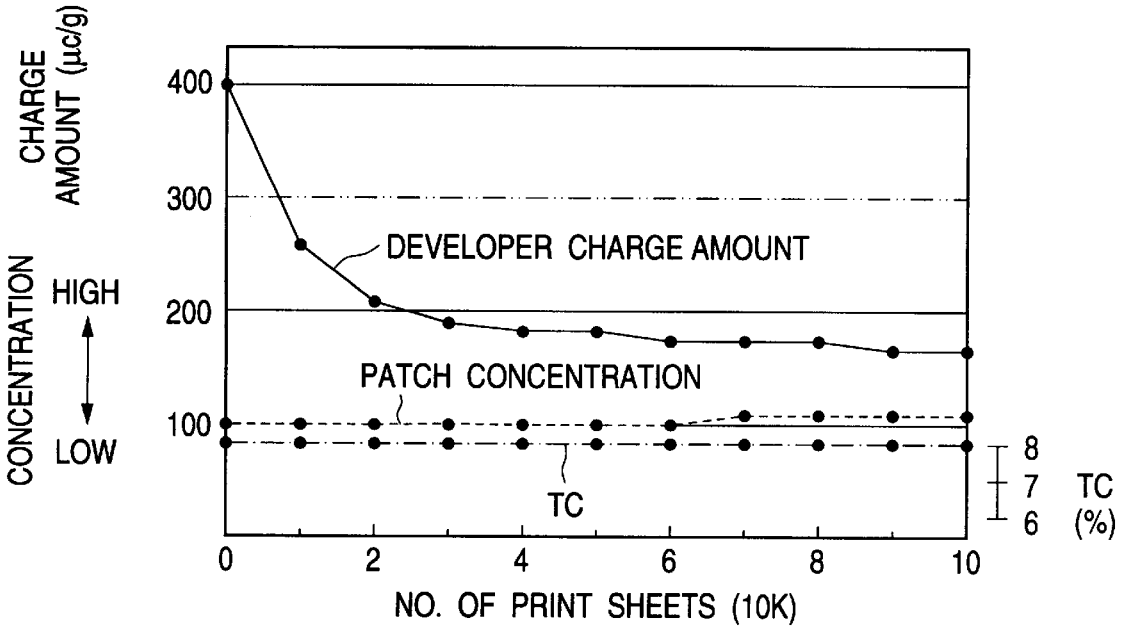
FIG. 20 is an illustration to show the relationship between the cumulative number of print sheets and toner concentration after application voltage correction.

FIG. 20 is an illustration to show changes of developer degradation amount (developer charge amount function), band patch image concentration, and toner concentration responsive to the number of print sheets after the application voltage or target concentration of the BCR 3 is corrected. As seen in the figure, although the developer is degraded, the band patch image concentration and the toner concentration are maintained almost constant.

Figure 21:
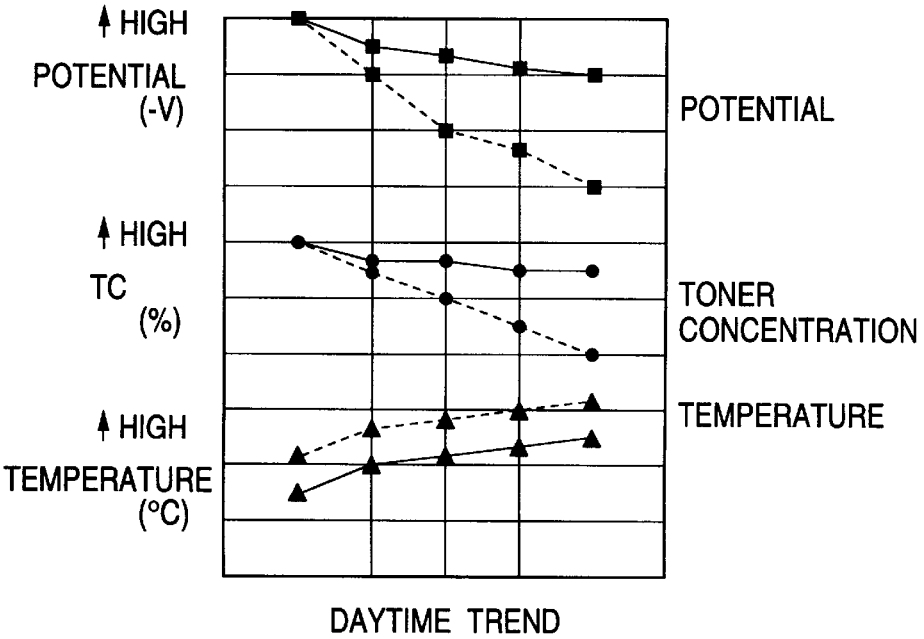
FIG. 21 is an illustration to show the relationship between temperature and toner concentration before and after application voltage correction.

Next, correction control responsive to temperature change will be discussed. FIG. 21 is an illustration to show charge potential and toner concentration change of the BCR 3 responsive to temperature change in the machine; the dotted lines are applied when no correction is made and the solid lines are applied when a correction which will be described below is made. As shown by the dotted lines in the figure, the charge potential and toner concentration lower as the temperature in the machine rises. Resultantly, as with the case in FIG. 14, the band patch image concentration heightens and the developer toner concentration is controlled so as to lower; finally, the print image concentration lowers. Then, in the embodiment, a correction is made for increasing the application voltage of the BCR 3 in response to a rise in the temperature. A temperature sensor for detecting the temperature in the machine is placed where correlation with the temperature of the photoreceptor 1 is taken, for example, at a position adjacent to the concentration sensor 6.

Figure 22:
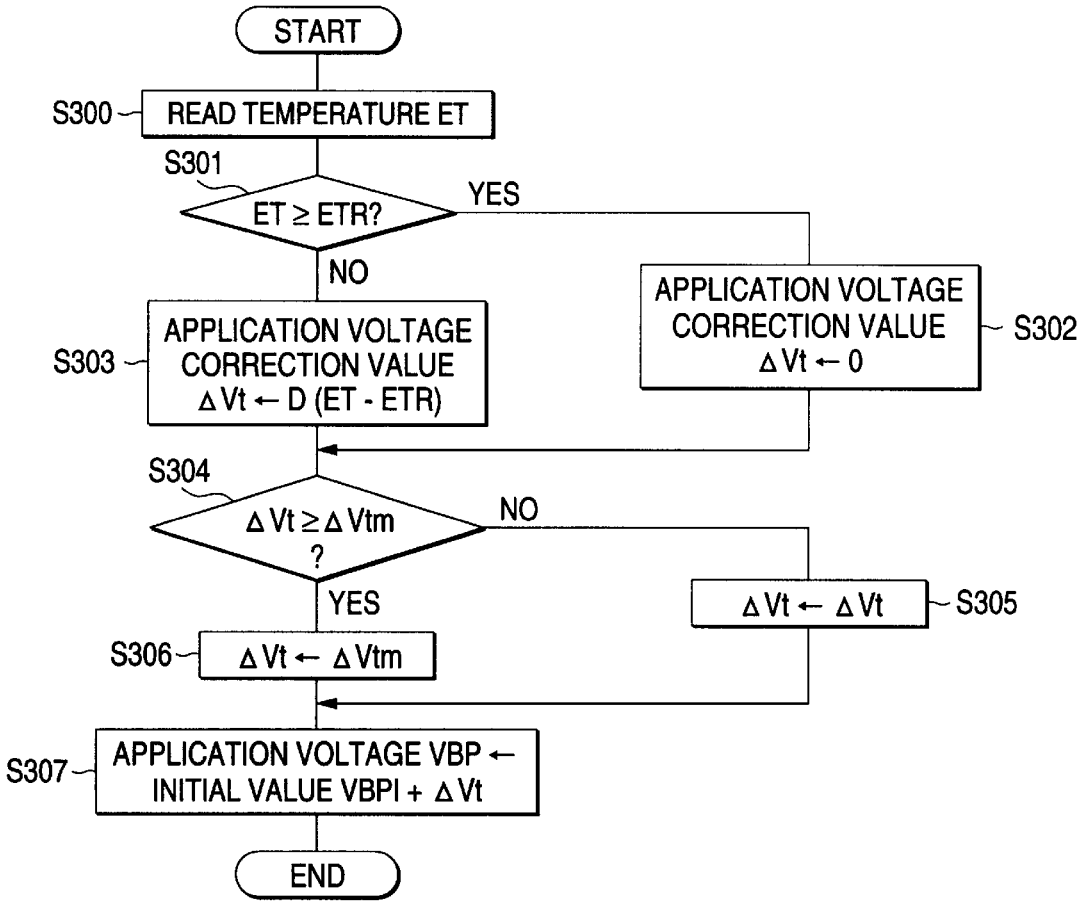
FIG. 22 is a flowchart for correcting application voltage in response to temperature.

FIG. 22 is a flowchart of control for increasing the application voltage of the BCR 3 in response to temperature rise. At step S300, machine temperature ET is read from the temperature sensor. At step S301, whether or not the temperature ET is equal to or higher than reference temperature ETR (for example, 24° C.) is determined. If the temperature ET is lower than the reference temperature ETR, control goes to step S302 and band patch image application voltage correction value of the BCR 3, ΔVt, is set to 0.

If the temperature ET is equal to or higher than the reference temperature ETR, control goes to step S303 and D (ET-ETR) is set as the band patch image application voltage correction value ΔVt. The constant D is a value predetermined based on an experimental value as the correction value ΔVt every 1° C. At step S304, whether or not the correction value ΔVt reaches upper limit value ΔVtm (for example, 10 volts) is determined. If the correction value ΔVt does not reach the upper limit value ΔVtm, control goes to step S305 and the correction value ΔVt is replaced with the value set at step S302 or S303. On the other hand, if the correction value ΔVt reaches the upper limit value ΔVtm at step S304, control goes to step S306 and the correction value ΔVt is set to the upper limit value ΔVtm. That is, the correction value ΔVt is clipped at 10 volts as ΔVtm. At step S307, the voltage resulting from adding the correction value ΔVt to initial value of band patch image application voltage, VBPI, is set as the application voltage VBP of the BCR 3 for band patch image.

Although the application voltage of the BCR is controlled in the correction control described with reference to FIG. 19 or 22, the band patch image target concentration or the application voltage to the developing device 5 may be controlled as with the correction control responsive to the wear amount of the photoreceptor 1 described with reference to FIG. 16. The target concentration control processing is similar to that described with reference to FIG. 16 and the application voltage to the developing device 5 can also be controlled in a similar manner and therefore will not be discussed again.

Figure 23:
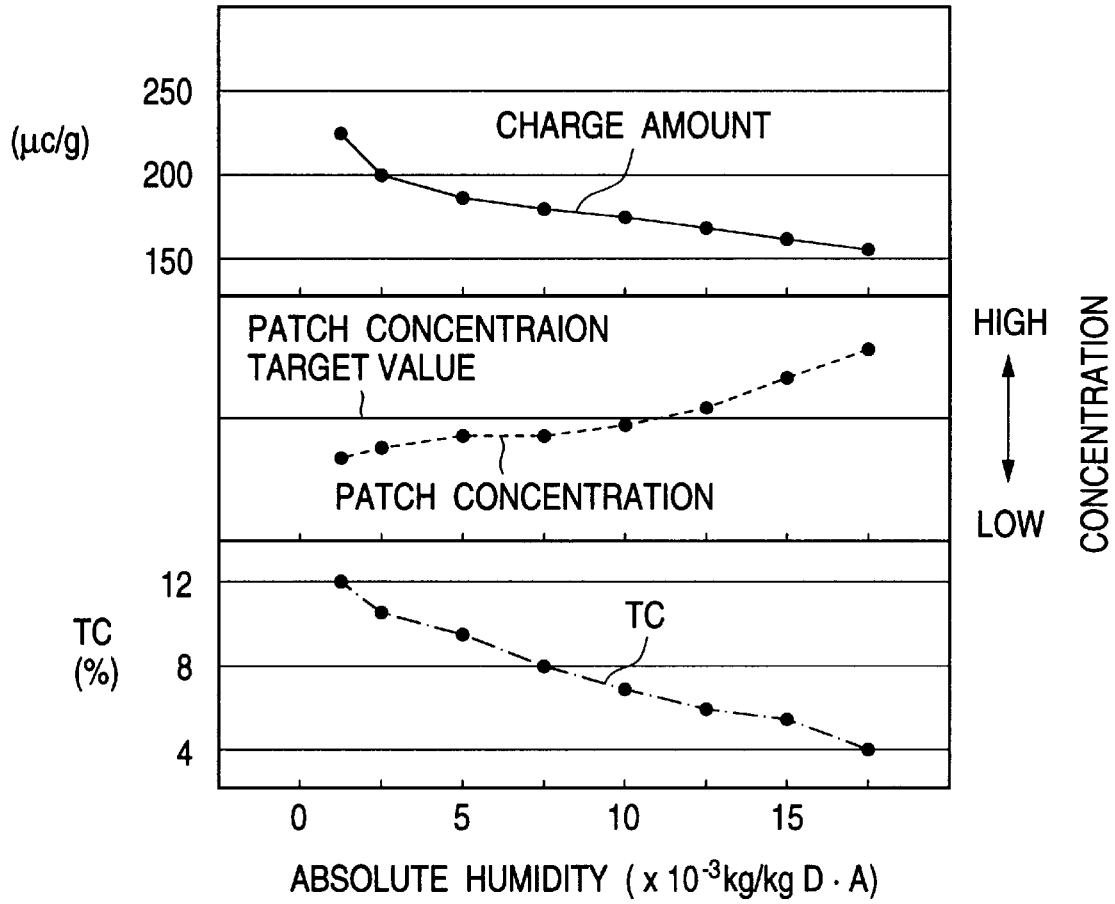
FIG. 23 is an illustration to show the relationship between humidity and toner concentration.

Next, correction control responsive to humidity change will be discussed. FIG. 23 is an illustration to show the relationship between humidity and developer charge amount. As shown here, as the humidity (absolute humidity) heightens, the charge amount lowers. Therefore, if the change amount change is ignored and a band batch image is formed, the band batch image concentration rises as the humidity rises.

The toner concentration is controlled so that the band batch image concentration becomes the patch image concentration target value. Thus, the toner concentration lowers with a rise in the band batch image concentration. Resultantly, the print image concentration lowers. As the humidity lowers, the toner concentration heightens and a problem of fog, etc., occurs. Then, in the embodiment, a correction is made so that as the humidity heightens, the application voltage of the BCR 3 is increased and that as the humidity lowers, the application voltage of the BCR 3 is decreased.

In addition to the application voltage control, the developing bias or patch image concentration target value may be controlled as in other correction control examples. The humidity used as correction control reference may be measured by a humidity sensor, but may be detected based on the resistance value of the BTR 7. Since the BTR 7 is controlled so as to supply a constant current, the resistance value of the BTR 7 can be detected based on change in the voltage applied to the BTR 7. On the other hand, since the resistance value of the BTR 7 is dependent on humidity, the humidity can be calculated from the resistance value.

Figure 24:
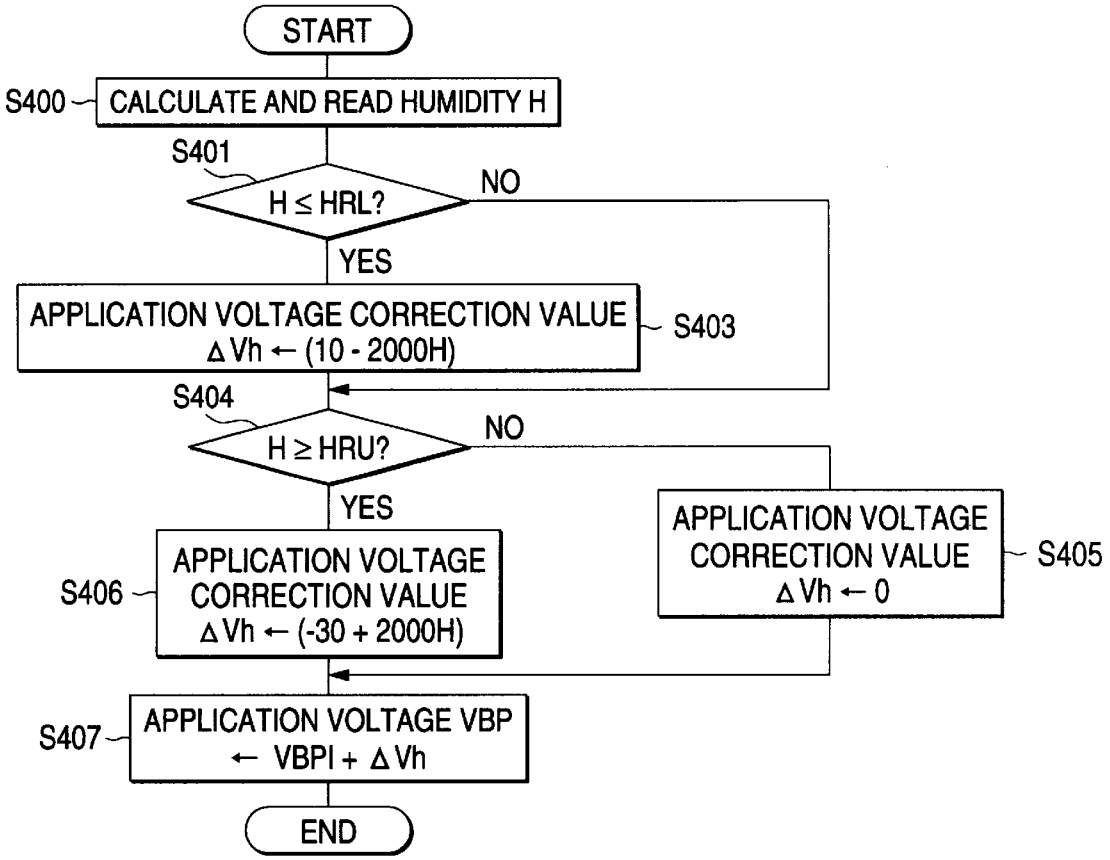
FIG. 24 is a flowchart for correcting application voltage in response to humidity.

FIG. 24 is a flowchart for controlling the application voltage of the BCR 3 in response to humidity. At step S400, humidity H in the machine is calculated based on the application voltage of the BTR 7. At step B401, whether or not the humidity H is equal to or lower than reference humidity HRL (for example, 0.005 kg/kgDA) is determined.

If the humidity H is equal to or lower than the reference humidity HRL, control goes to step S402 and (10−2000H) is set as band patch image application voltage correction value ΔVh. If the humidity H is higher than the reference humidity HRL, step S402 is skipped. At step S403, whether or not the humidity H is equal to or higher than reference humidity HRU (for example, 0.015 kg/kgDA) is determined. If the humidity E is equal to or higher than the reference humidity HRU, control goes to step S404 and (−30+2000H) is set ad the band patch image application voltage correction value ΔVh. If the humidity H is lower than the reference humidity HRU, control goes to step S405 and the band patch image application voltage correction value ΔVh is set to 0. At step S406, the voltage resulting from adding the correction value ΔVh to initial value of band patch image application voltage, VBPI, is set as the application voltage VBP of the BCR 3 for band patch image.

Figure 25:
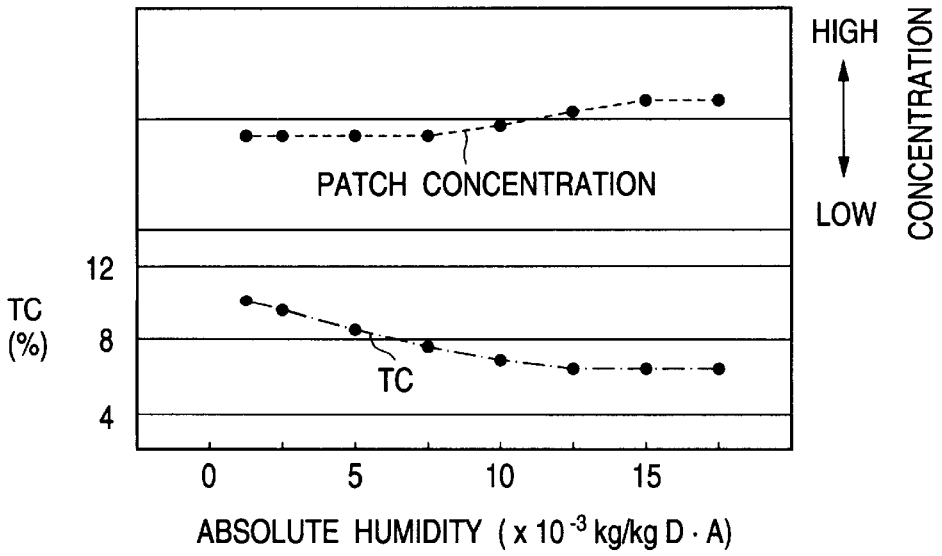
FIG. 25 is an illustration to show the relationship between humidity and toner concentration after application voltage correction.

FIG. 25 is an illustration to show changes of band patch image concentration and toner concentration when the application voltage of the BCR 3 is corrected in response to humidity. As a result of controlling the application voltage of the BDR 3 in accordance with the flowchart of FIG. 24, the band patch image concentration change amount lessens and the toner concentration (TC) does not largely depart from 8%, as shown in FIG. 25.

Although the BTR 7 undergoes constant current control as described above, the transfer voltage largely changes due to resistance change of the BTR 7 caused by temperature or humidity change, resistance value difference between individual bodies of the BTR 7, the film thickness of the photoreceptor 1, etc. The voltage change remains as a history still after electricity is eliminated or erased by the erasure device placed just before the BCR 3, producing variations in the charge potential of the BCR 3. Then, when a band patch image is formed, voltage application to the BTR 7 needs to be interrupted.

Figure 26:
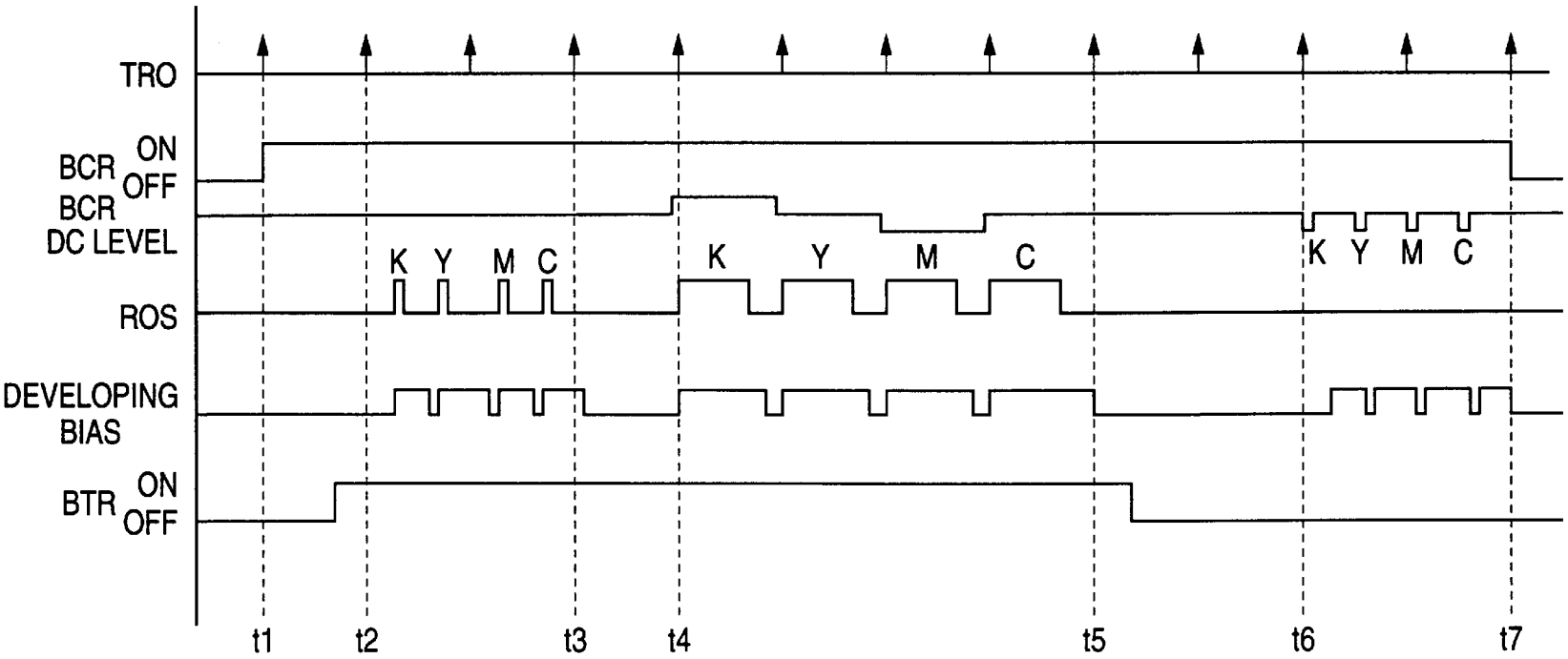
FIG. 26 is a timing chart at the time of full color print.
Figure 27:
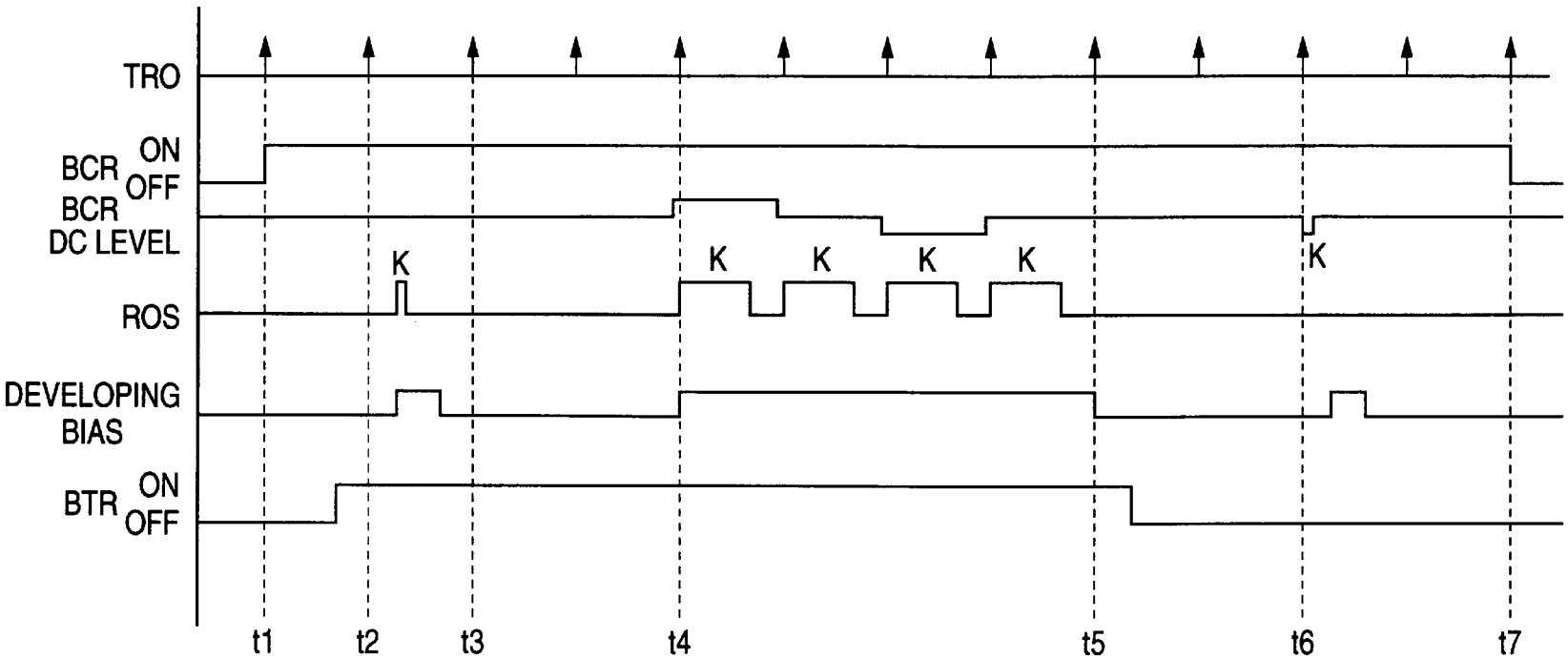
FIG. 27 is a timing chart at the time of monochrome print.

FIGS. 26 and 27 are timing charts to show the energization timings of the BCR 3, the ROS 4, the developing device 5Y, etc., and the BTR 7. FIG. 26 shows the full color print timings and FIG. 27 shows the monochrome print timings. In the figures, TR0 is a synchronizing signal output every revolution (cycle) of the belt 25; it is output when a mark put on the belt 25 is detected by a sensor.

In FIG. 26, the BCR 3 is turned on at timing t1 and the application voltage of the BTR 7 is turned on between timings t1 and t2. To form a point patch image, the bias voltages of the ROS 4 and the developing device 5*Y*, etc., are turned on and off appropriately in two cycles between timings t2 and t3. For image formation, the ROS 4 and the developing device 5*Y*, etc., are turned on and off between timings t4 and t5. Here, the DC level of the BCR 3 is changed matching the colors.

The application voltage of the BTR 7 is turned off between timings t5 and t6 and to form a band patch image, the developing devices 5Y, 5M, etc., are energized in two cycles between timings t6 and t7. Here, matching the band patch image forming position, the DC level of the BCR 3 is changed for producing a contrast potential.

Also in FIG. 27, the components are turned on and off at the timings indicated by the same reference characters as those in FIG. 26. However, since a monochrome image is formed, only the developing device 5K as the developing means is controlled on and off and the application voltage (bias) to the developing device 5K is turned on continuously between timings t4 and t5. As at the full color printing time, the application voltage of the BTR 7 is turned off one cycle is before a K-color band patch image is formed.

The image thus formed is transferred to the belt 25, then the application voltage of the BTR is turned off before the band patch image is formed, whereby variations in the potential remaining on the photoreceptor 1 caused by the BTR 7 can be lessened and resultantly, the charge potential caused by the BCR 3 can be maintained with high accuracy.

The application voltage control of the BCR 3 and the output control of the ROS 4 based on the point patch image concentration detection result and toner concentration control based on the band patch image concentration detection result are thus performed to adjust the image concentration to the target concentration. However, if the above controls are performed in one job for forming a number of images, a concentration difference occurs before and after the control. In such a case, the output image after the controls are performed becomes the correct concentration as desired, but the concentration is not stable in one job and it may be evaluated that the quality is poor. To form a number of images in one print job, charge potential control and toner concentration control can be inhibited for stabilizing the concentration in the single job.

The charge potential control based on the point patch image concentration is executed before a job and during execution of the job (interimage). The charge potential control before a job (control A) is executed, for example, before the first job is started after the image forming system is powered on or before the next job outputting as many sheets as a predetermined number (for example, 20 sheets) from the previous control A is started. A predetermined time may be adopted in place of the predetermined number of sheets. The control may be performed before the next job with the expiration of a predetermined time since the toner concentration control based on the band patch image concentration is started.

The charge potential control during job execution (control B) is performed each time as many sheets as the first predetermined number (for example, 20 sheets) are output from the previous control A or B. However, it is not executed until as many sheets as the second predetermined number less than the first predetermined number (for example, 5 sheets) are output from the job starts, whereby particularly in a small machine for outputting five or less print sheets in one job, image concentration change in the job is prevented and a sense of incongruity in looking can be eliminated. In the charge potential control, a correction value is retrieved from a table based on the point patch image concentration; in the control B, preferably one correction value is limited in such a manner that a correction value largely departing from the correction value obtained based on the previously detected concentration is not selected. For example, in a correction value table set stepwise, an entry within a predetermined step range is selected.

The toner concentration control based on the band patch image concentration (control C) is executed, for example, after the first job after the image forming system is powered on or after the job outputting as many sheets as a predetermined number (for example, 20 sheets) from the previous control C. A predetermined time may be adopted in place of the predetermined number of sheets as with the control A. However, if the predetermined time has elapsed in a job, the control C is not executed in the job.

Figure 28:
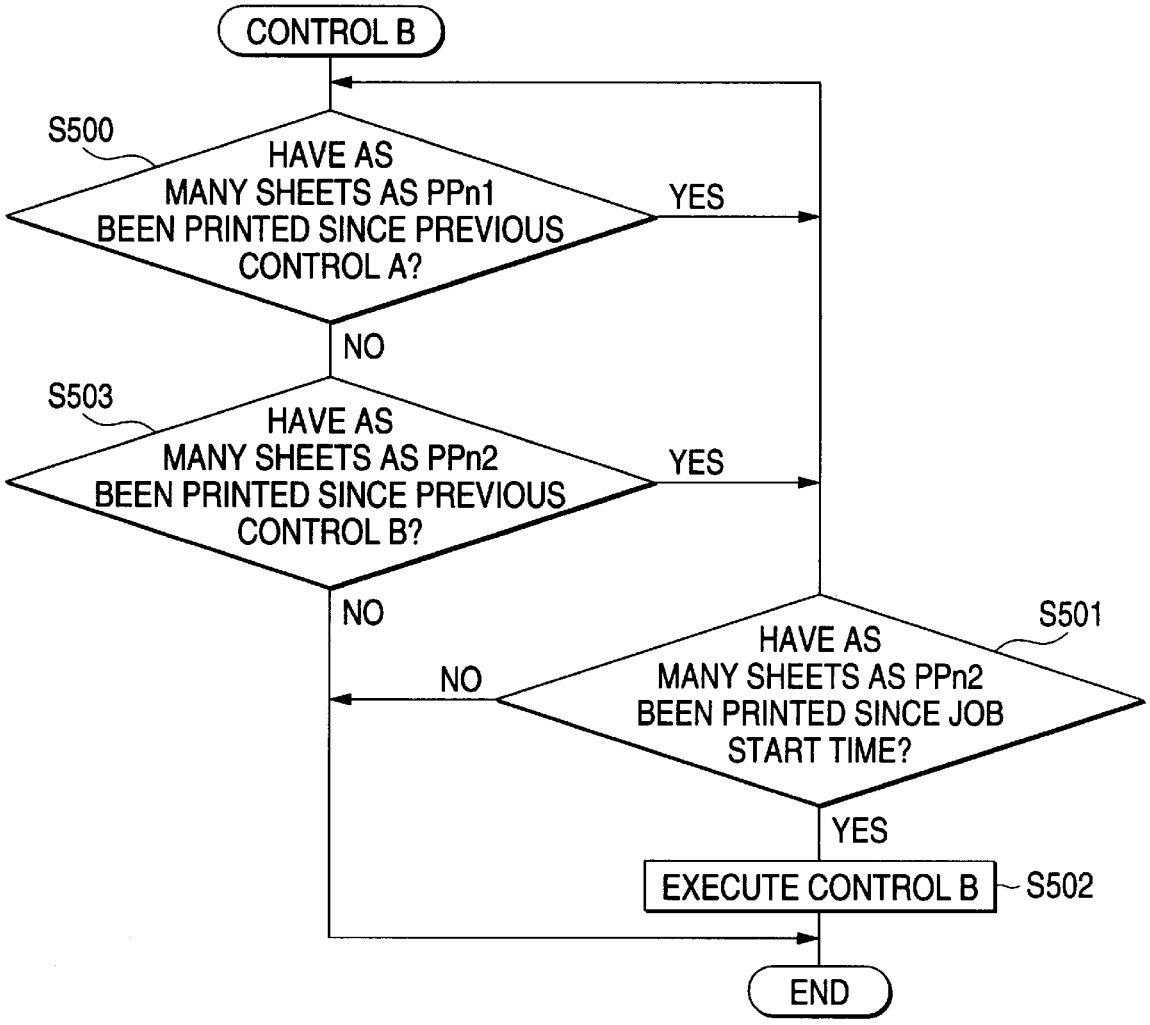
FIG. 28 is a flowchart of potential control to be executed during job execution in a mode for stabilizing concentration in the same job.

The operations of the controls B and C will be discussed with reference to flowcharts. FIG. 28 is a flowchart of the operation of control B. At step S500, whether or not a predetermined number of sheets PPn1, for example, 20 sheets have been printed since the previous control A is determined. If as many sheets as the predetermined number have been printed, control goes to step S501 and whether or not a predetermined number of sheets PPn2, for example, 5 sheets have been printed since the job start time is determined. If as many sheets as the predetermined number have been printed, control goes to step S502 and the control B is executed.

If as many sheets as the predetermined number PPn 1 have not yet been printed since the control A, control goes to step S503 and whether or not as many sheets as the predetermined number PPn1 have been printed since the previous control B is determined. If as many sheets as the predetermined number have been printed, control goes to step S501; otherwise, the process is terminated.

Figure 29:
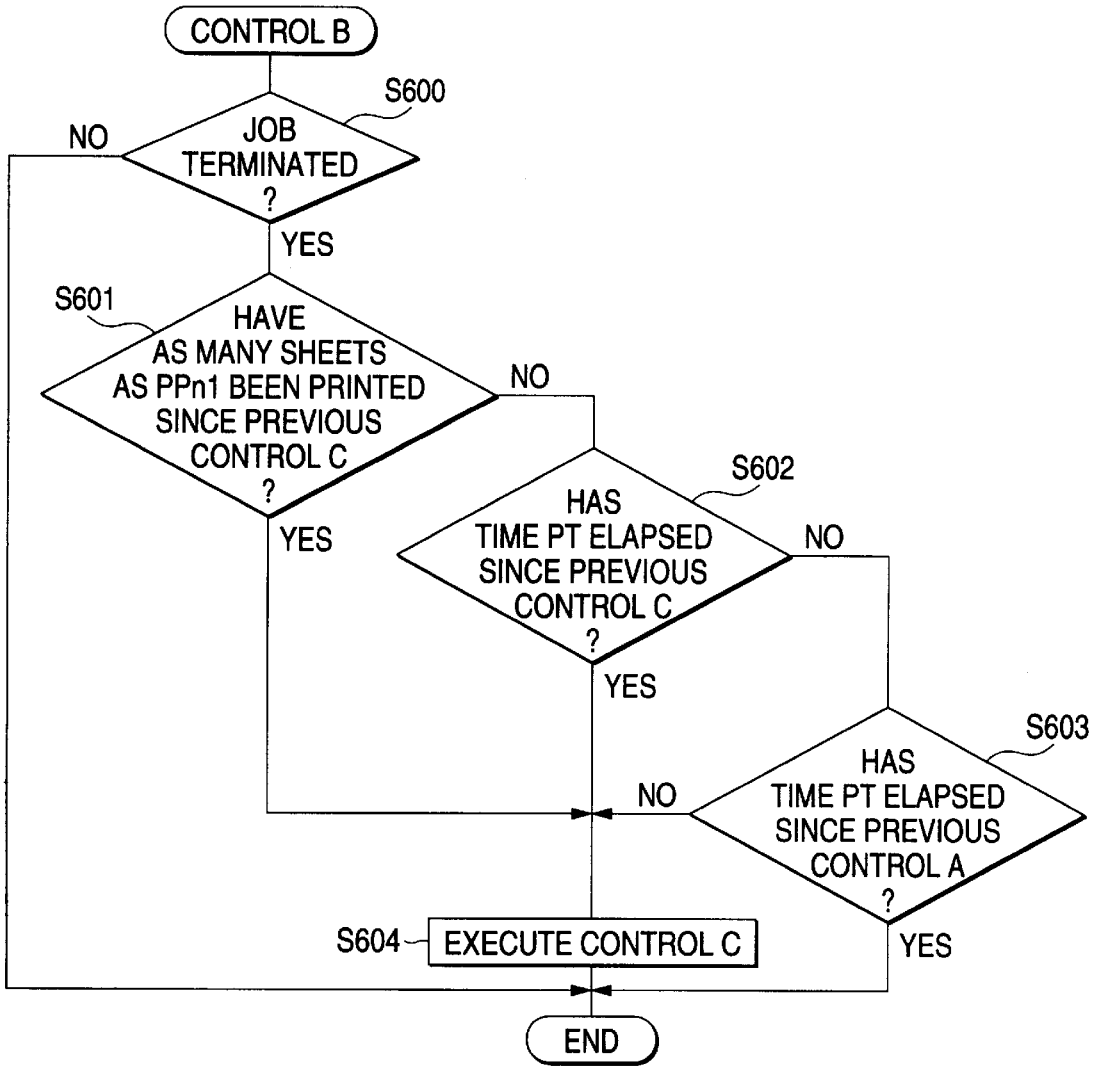
FIG. 29 is a flowchart of toner concentration control to be executed after job execution in the mode for stabilizing concentration in the same job.

FIG. 29 is a flowchart of the operation of the control C. At step S600, whether or not the job has been terminated is determined. If the job is being executed, the process is terminated. If the job has been terminated, control goes to step S601 and whether or not as many sheets as a predetermined number PPn1 have been printed since the previous control C is determined. If as many sheets as the predetermined number have been printed, control goes to step S604 and the control C is executed. If as many sheets as the predetermined number PPn 1 have not yet been printed since the previous control C, control goes to step S602 and whether or not a predetermined time PT has elapsed since the previous control C is determined. If the predetermined time PT has elapsed, control goes to step S604. If the predetermined time PT has not yet elapsed from the previous control C, control goes to step S603 and whether or not the predetermined time PT has elapsed since the previous control A is determined. If the predetermined time PT has elapsed, control goes to step S604. If the predetermined time PT has not yet elapsed from the previous control A, the process is terminated.

As seen from the description made so far, according to the invention, the toner patch image can be prepared at the contrast potential between the developing bias and the charge potential produced by the BCR with the potential on the image carrier not affected by environmental change, daylight change, image carrier characteristics, etc. Therefore, for example, if toner supply is controlled so that the concentration of the toner patch image prepared by the image forming system of the invention becomes the reference value, the toner concentration can be controlled constant without executing a process of controlling the photoreceptor potential at a constant value using a potential sensor; the effect of eliminating the need for the potential sensor can be produced.

According to the invention, toner concentration fluctuation caused by wear of the image carrier, temperature, humidity, degradation of the developer, etc., can be lessened; resultantly, a print image with small concentration variations can be provided.

Figure 30:
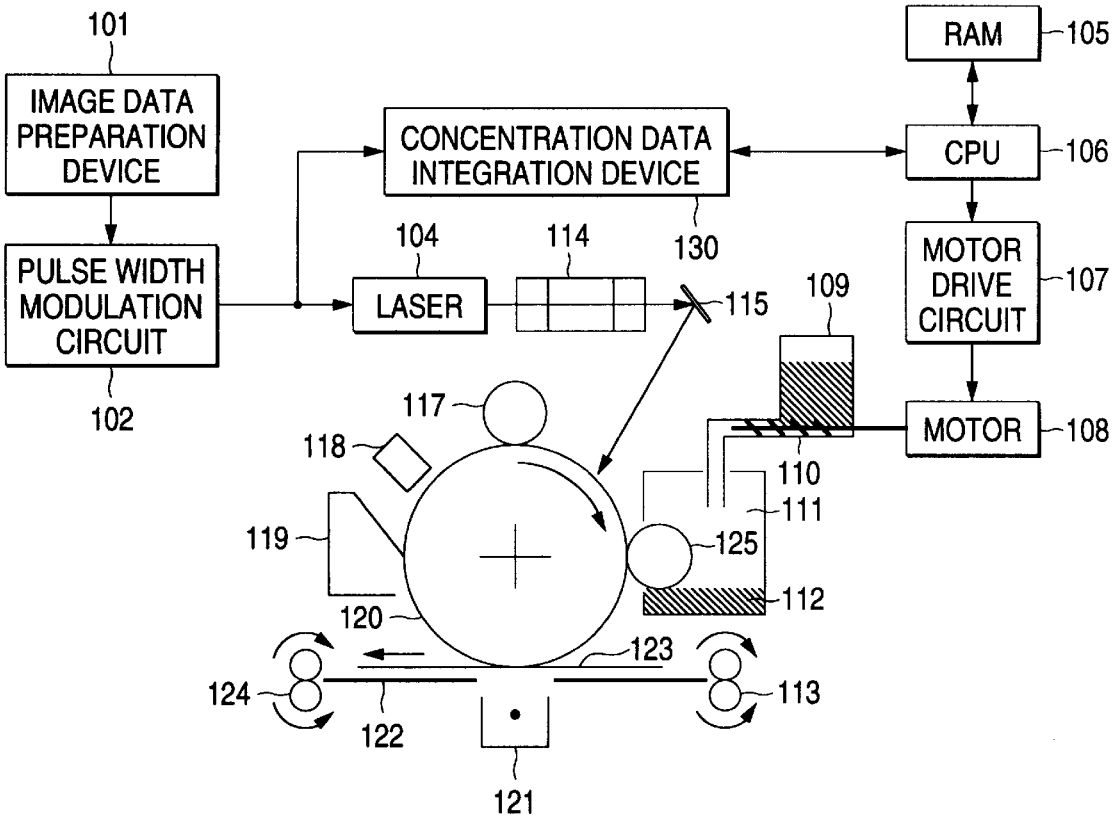
FIG. 30 in an illustration to show a general configuration of a printer to which the invention is applied.
Figure 39:
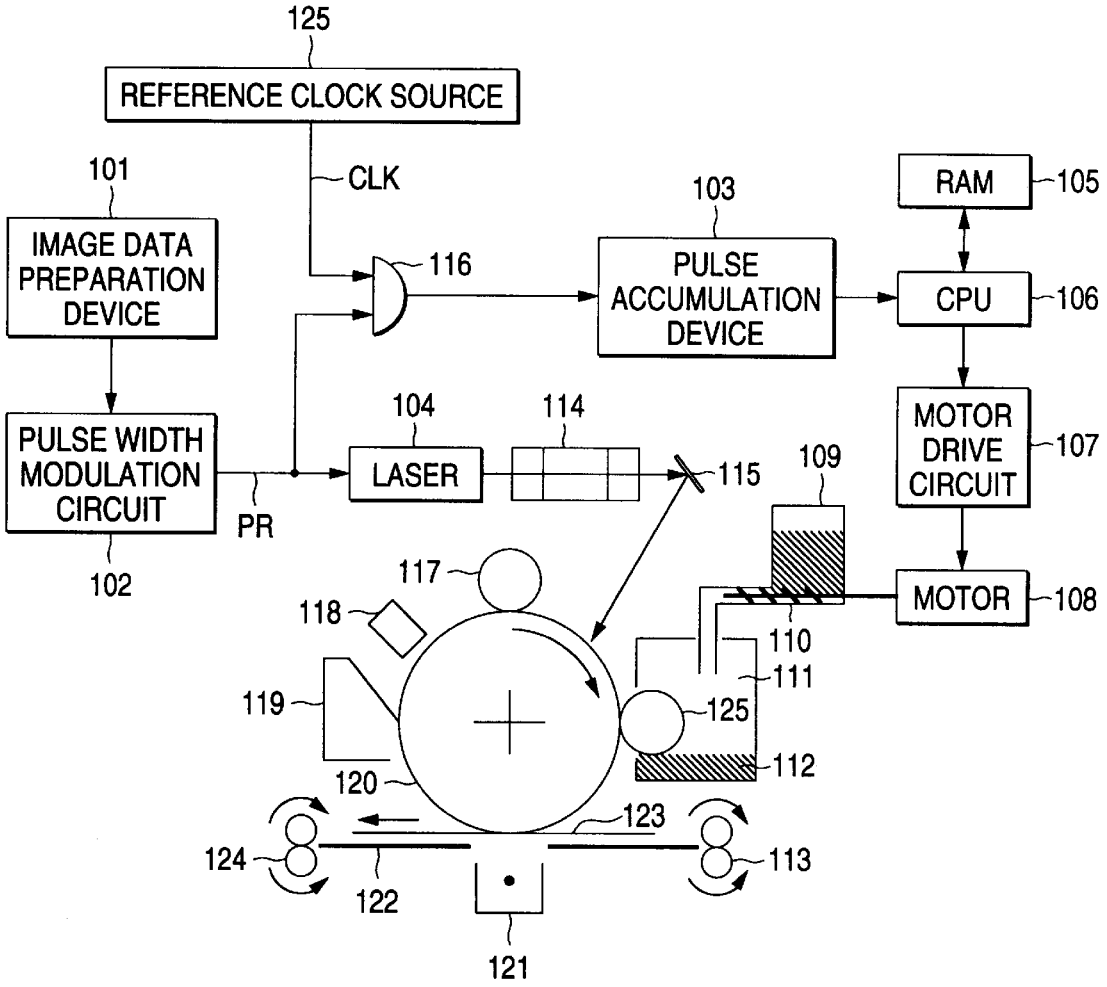
FIG. 39 PRIOR ART
FIG. 39 is a diagram to show the general configuration of a conventional digital printer having a developer concentration control function.
Figure 40:
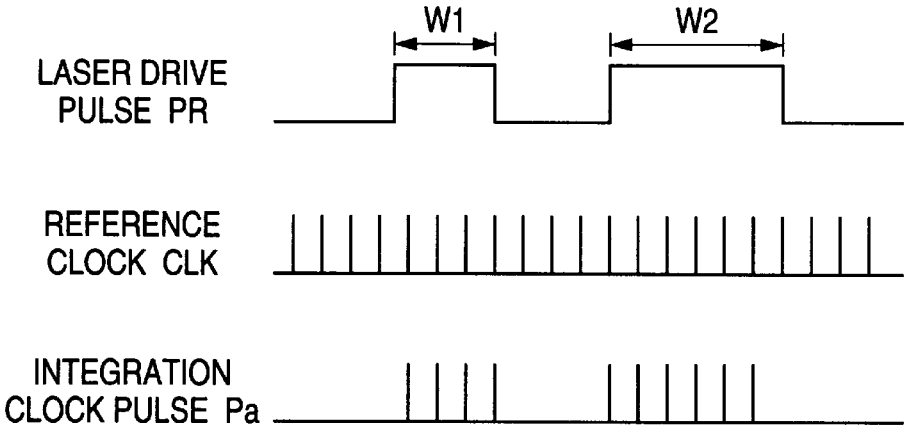
FIG. 40 PRIOR ART
FIG. 40 is a chart to show the operation timing of the conventional printer.
Figure 41:
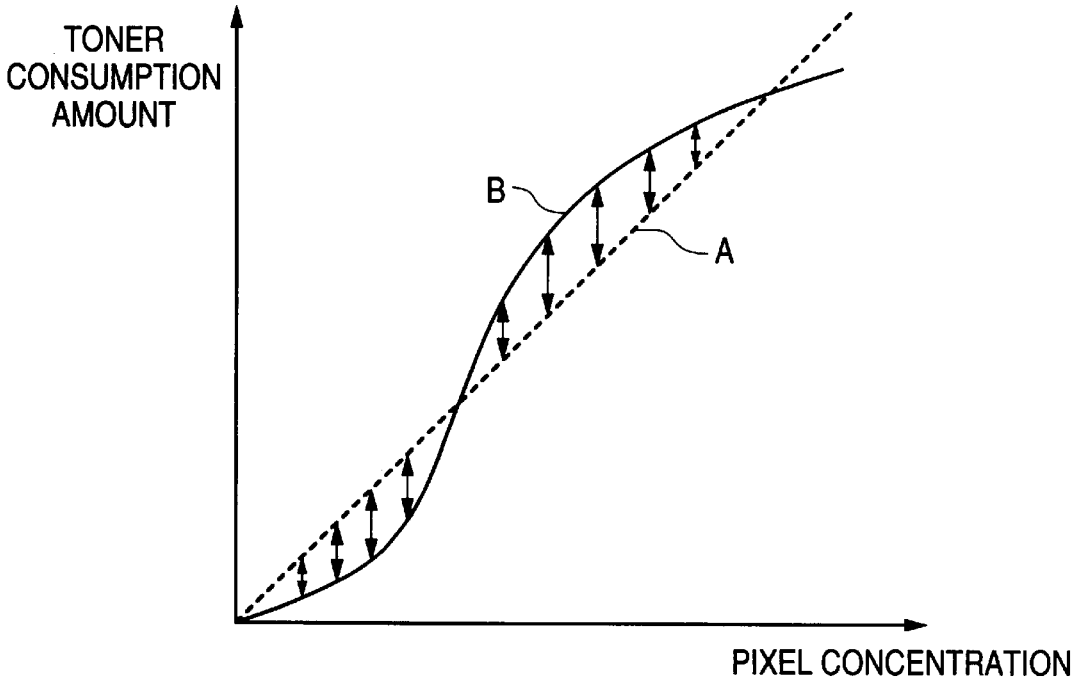
FIG. 41 PRIOR ART
FIG. 41 is a graph to show the relationship between pixel concentration and toner consumption amount.

Next, second to sixth embodiments of the invention will be discussed. FIG. 30 is an illustration to show a general configuration of a digital printer to which the invention is applied. Parts identical with or similar to those previously described with reference to FIG. 39 are denoted by the same reference numerals or characters in FIG. 30. The embodiments are characterized by the fact that a concentration data integration device 130 for executing analog addition of the pulse widths of laser drive pulses Pr and predicting the toner consumption amount is provided in place of the pulse accumulation device 103 in the conventional printer.

Figure 32:
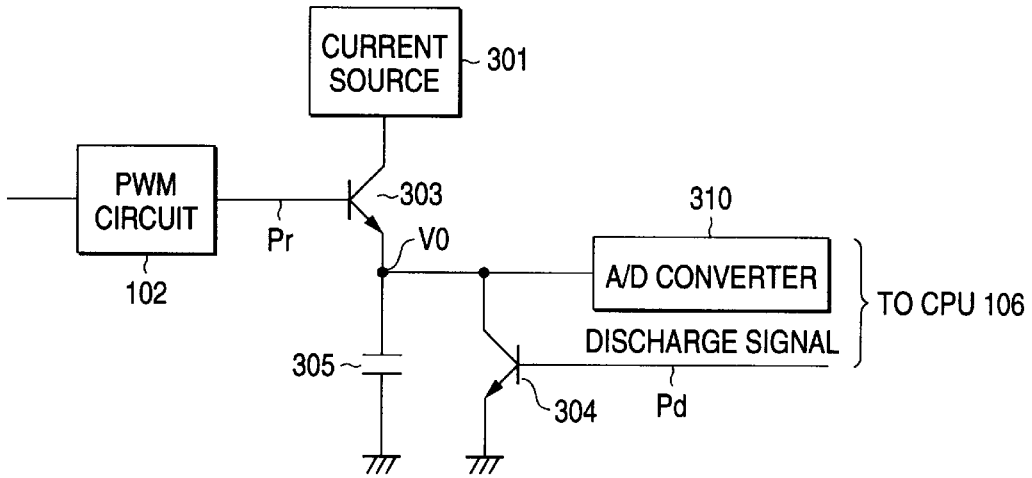
FIG. 32 is a block diagram to show the configuration of a second embodiment of the invention.
Figure 33:
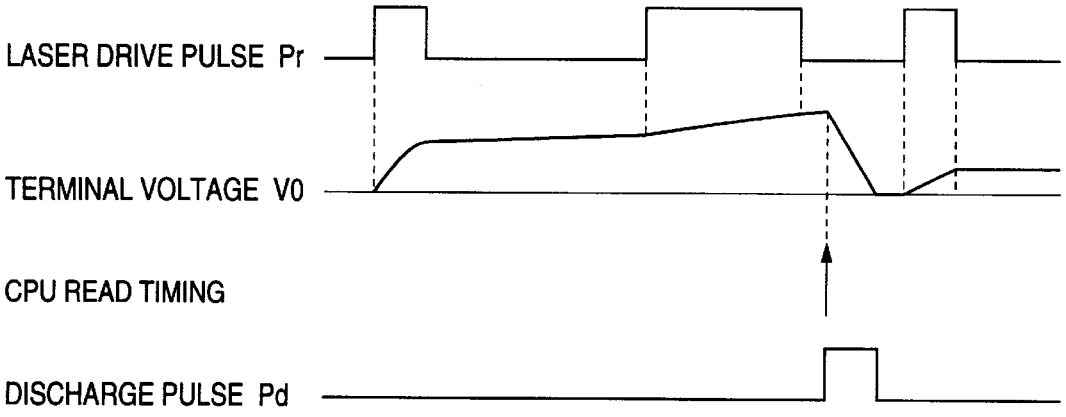
FIG. 33 is a chart to show signal waveforms of the main parts in FIG. 32.

FIG. 32 is a block diagram to show the configuration of the concentration data integration device 130 of the second embodiment of the invention. FIG. 33 is a chart to show signal waveforms of the main parts of the concentration data integration device 130. A laser drive pulse Pr output from a pulse width modulation (PWM) circuit 102 is input to a base of an NPN bipolar transistor (simply, NPN) 303. The NPN 303 has a collector connected to a current source 301 and an emitter connected to one end of a capacitor 305, a collector of an NPN 304, and an input terminal of an A/D converter 310. Output data of the A/D converter 310 is supplied to a CPU 106. A discharge pulse Pd is supplied from the CPU 106 to a base of the NPN 304.

In such a configuration, when the laser drive pulse Pr is input to the base of the NPN 303, the NPN 303 is turned on by the duration equivalent to the pulse width of the laser drive pulse Pr, thus charges equivalent to the on-duration of the pulse width are accumulated in the capacitor 305. Therefore, when the laser drive pulses Pr are input in sequence, terminal voltage Vo of the capacitor 305 denotes a voltage representing the total of the pulse widths of the laser drive pulses Pr.

Figure 31:
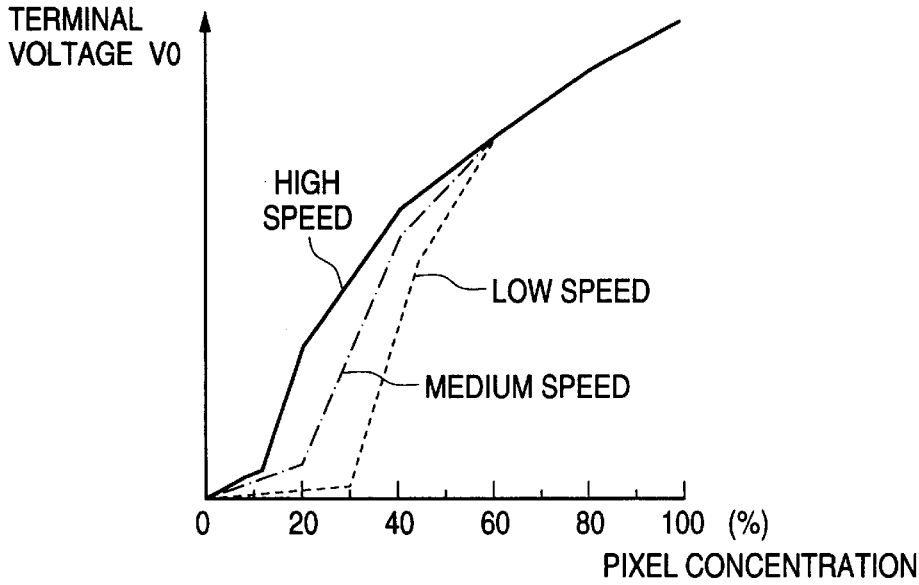
FIG. 31 is a graph to show the relationship between pixel concentration and toner consumption amount in the invention.

FIG. 31 is a graph to represent the relationship between a pixel concentration (pulse width W of laser drive pulse Pr) and the terminal voltage Vo of the capacitor 305 in the embodiment with switching speed of the NPN 303 as a parameter. Generally, switching elements such as bipolar transistors cannot follow a short input signal. Therefore, even if the laser drive pulse Pr is input to the control terminal (base), if the pulse width of the pulse is short, no charge is accumulated in the capacitor 305. Thus, the relationship between the pixel concentration and the terminal voltage Vo in the embodiment also draws an S-letter curve like the relationship between the actual pixel concentration and toner consumption amount.

Therefore, if the toner consumption amount is predicted based on the terminal voltage Vo of the capacitor 305, it can be predicated accurately. The slower the switching speed of the NPN 303, the sharper the curve. Thus, if the switching speed of the NPN 303 is previously selected so that the actual toner consumption amount and the prediction amount approach each other, the terminal voltage Vo of the capacitor 305 and the actual toner consumption show higher correlation.

On the other hand, the terminal voltage Vo is converted into a digital signal by the A/D converter 310 and the digital signal is read by the CPU 106 at a predetermined timing and is stored. When reading the output data of the A/D converter 310, the CPU 106 supplies a discharge pulse Pd to the base of the NPN 304 for energization. Resultantly, the charges accumulated in the capacitor 305 are discharged rapidly through the NPN 304 and the terminal voltage Vo of the capacitor 305 also lowers rapidly.

After this, likewise, charges equivalent to the pulse widths of the laser drive pulses are accumulated in the capacitor 305 and the terminal voltage Vo is read into the CPU 106 every predetermined timing. Therefore, if the digital data read into the CPU 106 is integrated, the integration value represents the toner consumption amount and the toner consumption amount can be predicted accurately based on the accumulation value.

Figure 34:
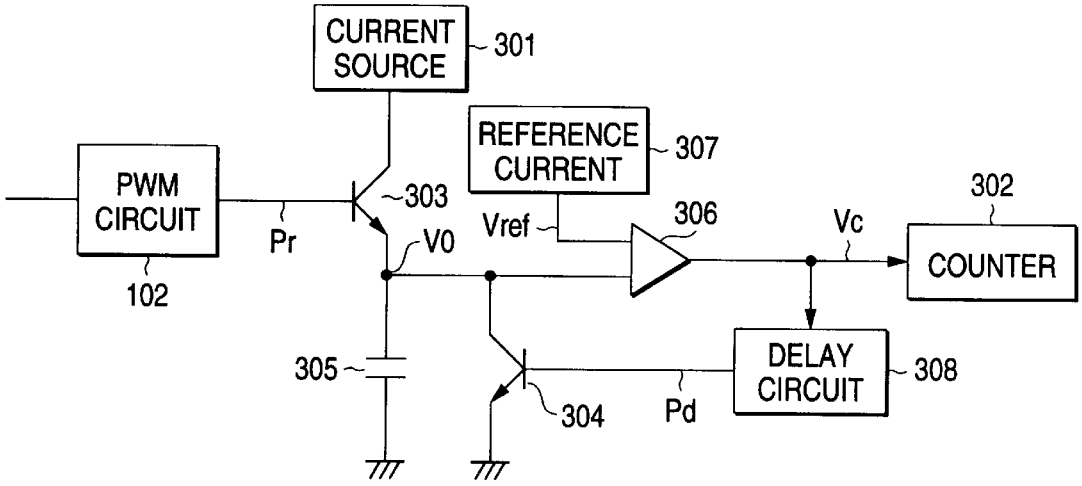
FIG. 34 is a block diagram to show the configuration of a third embodiment of the invention.
Figure 35:
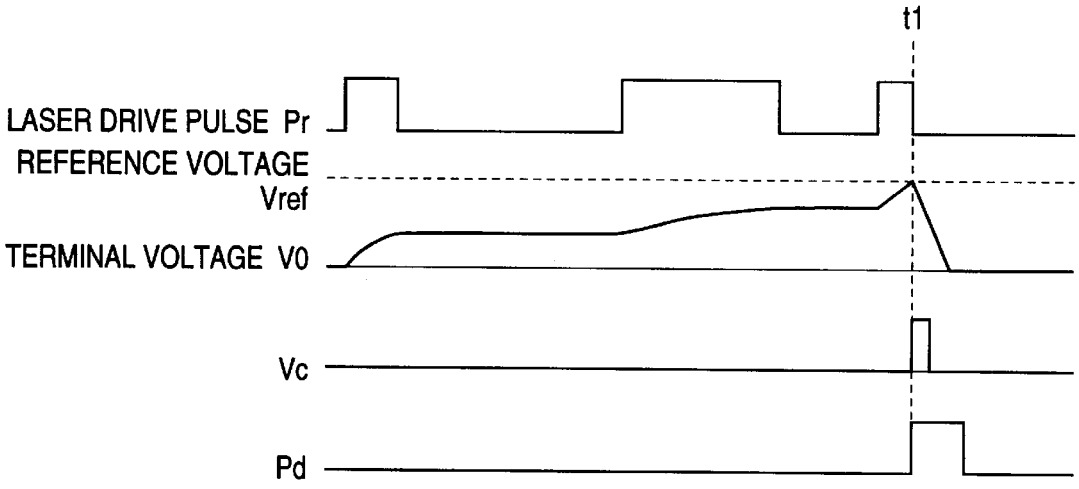
FIG. 35 is a chart to show signal waveforms of the main parts in FIG. 34.

FIG. 34 is a block diagram to show the configuration of a third embodiment of the invention. Parts identical with or similar to those previously described with reference to FIG. 32 are denoted by the same reference numerals or characters in FIG. 34. FIG. 35 is a chart to show the signal waveforms of the main parts in FIG. 34.

A laser drive pulse output from a pulse width modulation (PWM) circuit 102 is input to a base of an NPN 303. The NPN 303 has a collector connected to a current source 301 and an emitter connected to one end of a capacitor 305, a collector of an NPN 304, and one input terminal of a comparator 306. An output terminal of a reference power supply 307 is connected to the other input terminal of the comparator 306. An output pulse of the comparator 306 is input to a counter 302 and a delay circuit 308 and output of the delay circuit 308 is input to a base of the NPN 304.

In such a configuration(when the laser drive pulse Pr is input to the base of the NPN 303, charges equivalent to the pulse width of the laser drive pulse Pr are accumulated in the capacitor 305 in a similar manner to that as described above. Therefore, when the laser drive pulses Pr are input in sequence, terminal voltage Vo of the capacitor 305 denotes a voltage representing the total of the pulse widths of the laser drive pulses.

The terminal voltage Vo is always compared with a reference voltage Vref by the comparator 306. When the terminal voltage Vo reaches the reference voltage Vref at time t1, output voltage Vc of the comparator 306 goes high. The delay circuit 308 detects the rising edge of the output voltage Vc and generates a 1-shot discharge pulse Pd for conducting the NPN 304. Resultantly, the charges accumulated in the capacitor 305 are discharged rapidly through the NPN 304 and the terminal voltage Vo of the capacitor 305 also lowers rapidly, thus the output voltage Vc of the comparator 306 falls. On the other hand, the counter 302 counts change in the output voltage Vc of the comparator 306.

After this, likewise, charges equivalent to the pulse widths of the laser drive pulses are accumulated in the capacitor 305 and each time the terminal voltage Vo reaches the reference voltage Vref, the counter 302 is incremented. Therefore, the counter 302 counts a value representing the total of the pulse widths of the laser drive pulses and if the value of the counter 302 is referenced, the toner consumption amount can be predicted.

Figure 36:
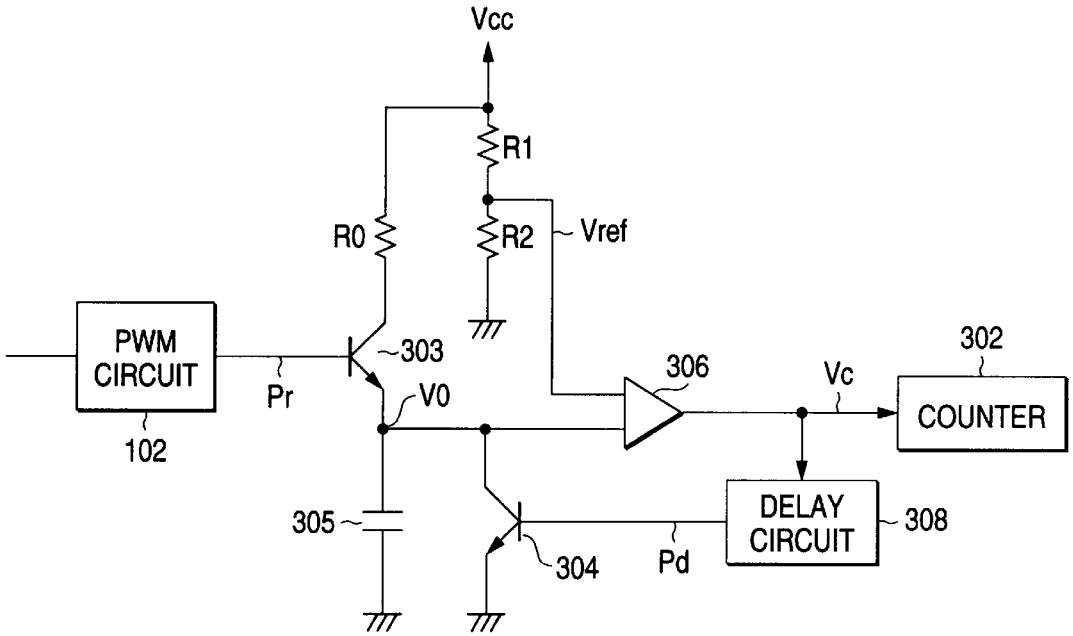
FIG. 36 is a block diagram to show the configuration of a fourth embodiment of the invention.

FIG. 36 is a block diagram to show the configuration of a fourth embodiment of the invention. Parts identical with or similar to those previously described with reference to FIG. 34 are denoted by the same reference numerals or characters in FIG. 36. The fourth embodiment is characterized by the fact that the voltage Vcc of the system power supply is divided by resistors R1 and R2 to generate reference voltage Vref and is connected via resistor R0 to a collector of an NPN 303.

According to this embodiment, if the power supply voltage Vcc fluctuates and the relationship between the on-duration of the NPN 303 and terminal voltage Vo of a capacitor changes, the reference voltage Vref also fluctuates accordingly. Thus, the effect of the fluctuation of the power supply voltage Vcc on the count of a counter 302 is canceled and the toner consumption amount can be predicated accurately.

By the way, in the above embodiments, the pulse width of a laser drive pulse input while the capacitor 305 is discharged cannot be measured, thus the predication result contains an error accordingly. Then, in fifth and sixth embodiments which will be discussed below, laser drive pulse input while a capacitor is discharged can also be detected.

Figure 37:
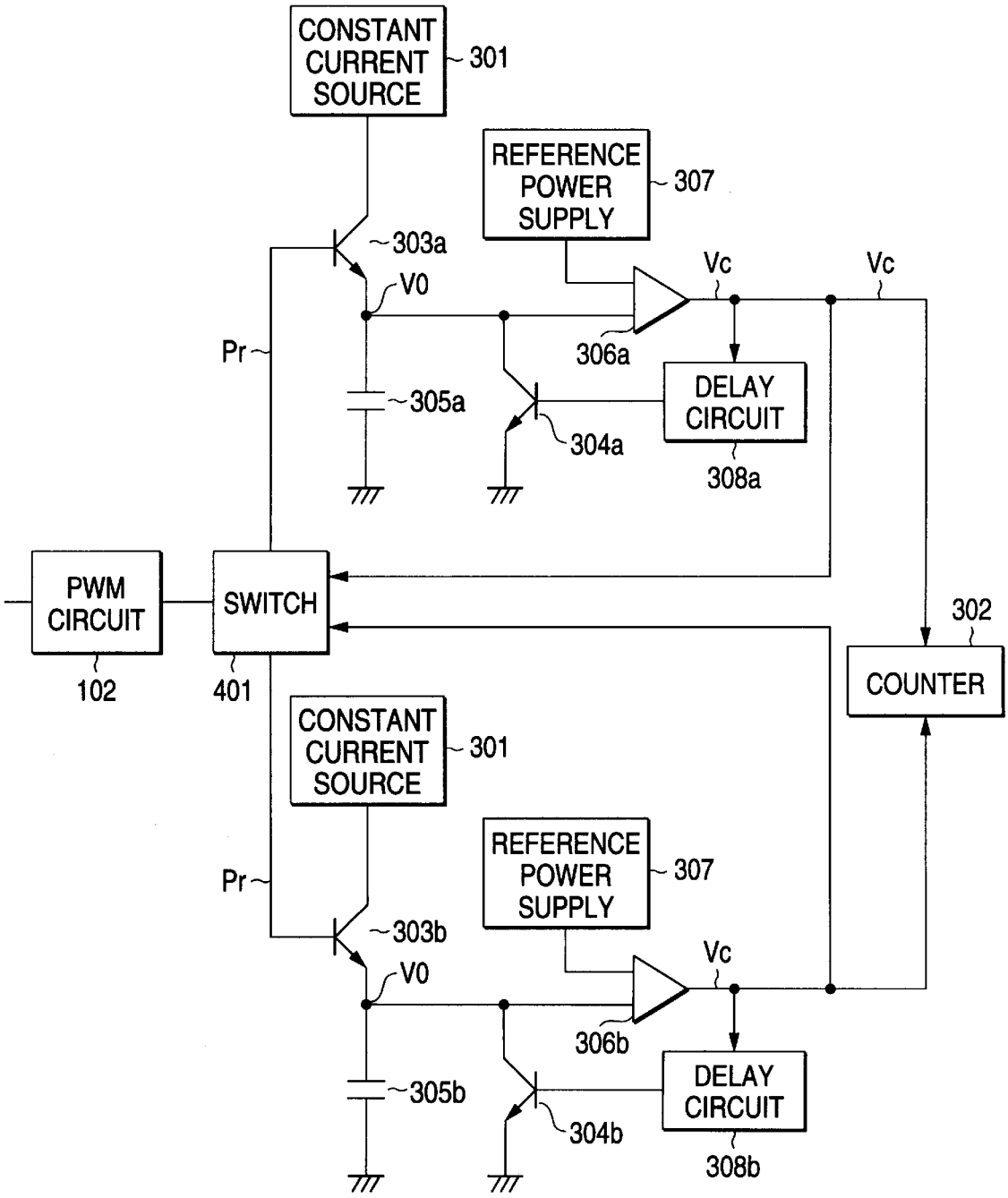
FIG. 37 is a block diagram to show the configuration of a fifth embodiment of the invention.

FIG. 37 is a block diagram to show the configuration of a fifth embodiment of the invention. Parts identical with or similar to those previously described are denoted by the same reference numerals or characters in FIG. 37. The fifth embodiment is characterized by the fact that two units of the configuration described in the second embodiment are provided and that a switch 401 is provided for using the configurations in a time division manner.

In the configuration of the fifth embodiment, a laser drive pulse Pr output from a PWM circuit 102 initially is input through the switch 401 to a base of an NPN 303*a*. Thus, charges representing the total of the pulse widths of the laser drive pulses are accumulated in a capacitor 305*a*. When terminal voltage Vo of the capacitor 305*a* reaches reference voltage Vref and output voltage Vc of a comparator 306*a* rises, the capacitor 305*a* is discharged and a counter 302 is incremented in a similar manner to that described above.

On the other hand, in this embodiment, the rising edge of the output voltage Vc of the comparator 306*a* is detected and the switch 401 switches the output destination of the laser drive pulse to an NPN 303*b*. Thus, after this, the charges representing the total of the pulse widths of the laser drive pulses are accumulated in a capacitor 305*b*. When terminal voltage Vo of the capacitor 305*b* reaches reference voltage Vref and output voltage Vc of a comparator 306*b* rises, the capacitor 305*b* is discharged and the counter 302 is incremented in a similar manner to that described above. Again, the switch 401 switches the output destination of the laser drive pulse to the NPN 303*a*.

Thus, also in this embodiment, the counter 302 counts a value representing the total of the pulse widths of the laser drive pulses and if the value of the counter 302 is referenced, the toner consumption amount can be predicted accurately.

Figure 38:
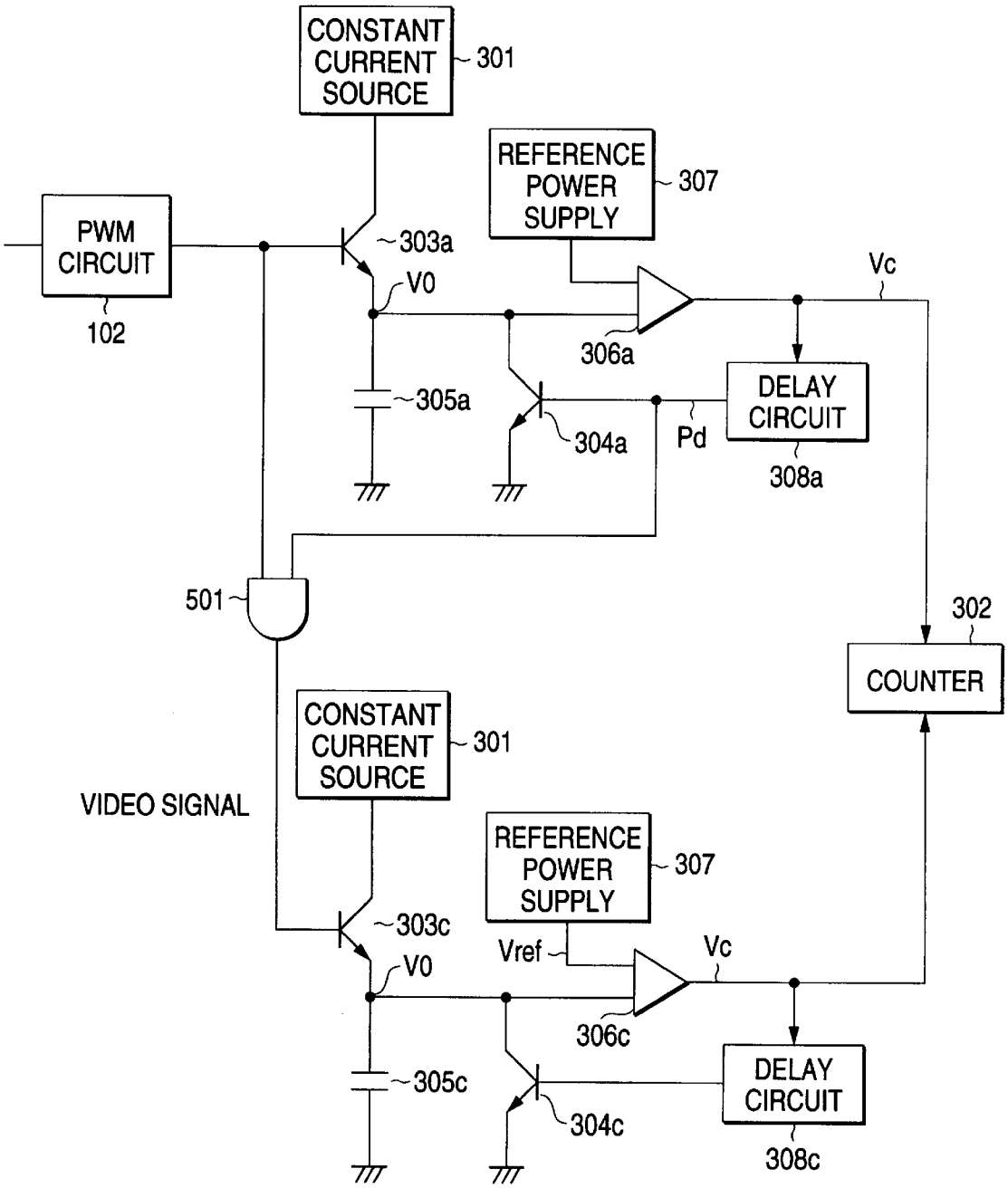
FIG. 38 is a block diagram to show the configuration of a sixth embodiment of the invention.

FIG. 38 is a block diagram to show the configuration of a sixth embodiment of the invention. Parts identical with or similar to those previously described with reference to FIG. 37 are denoted by the same reference numerals or characters in FIG. 38. In the fifth embodiment, the two units of the configuration are used alternately. The sixth embodiment is provided with a 2-input AND gate 501 receiving a discharge pulse Pd output from a delay circuit 308*a* and a laser drive pulse Pr and uses one configuration in a similar manner to that in the second embodiment and the other configuration to measure the pulse widths of the laser drive pulses only while a capacitor 305*a* in the one configuration is discharged.

In the above configuration of the sixth embodiment, terminal voltage Vo of the capacitor 305*a* reaches reference voltage Vref and output voltage Vc of a comparator 306*a* rises. When a delay circuit 308*a* generates a discharge pulse Pd in synchronization with the rising edge of the output voltage Vc, the laser drive pulse input at this time causes an NPN 303*c* to be placed into conduction, thus charges responsive to the pulse widths of the laser drive pulses input meanwhile are accumulated in a capacitor 305*c*. When terminal voltage Vo of the capacitor 305*c* reaches reference voltage Vref and output voltage Vc of a comparator 306*c* rises, the capacitor 305*c* is discharged and a counter 302 is incremented in a similar manner to that described above.

Thus, also in this embodiment, the toner consumption amount can be measured while the capacitor is discharged, so that the toner consumption amount can be predicted furthermore accurately.

In the description of the above embodiments, the invention is applied to a color printer, but not limited to it. The invention can also be applied to a facsimile machine, copier, etc.

In the above embodiments, the toner concentration is adjusted based on the predication value of the toner consumption amount, but the predication value may be used as a parameter to determine the life of a toner cartridge, a fuser, etc.

According to the invention, the following effect is achieved:

The bipolar transistor is controlled in conduction by laser drive pulse pulse-width-modulated according to the pixel concentration. At this time, the terminal voltage of the charge accumulation means charged with the current flowing through the bipolar transistor and the actual toner consumption amount show extremely high correlation. Thus, if the toner consumption amount is predicted based on the terminal voltage of the charge accumulation means, it can be predicted accurately.

What is claimed is:

1. An image forming system adopting a dual-component inversion developing system for forming on an image carrier a toner patch image used for detecting an image concentration and controlling an image forming condition based on the concentration of the toner patch image, said image forming system comprising:

charge means for uniformly charging a surface of the image carrier;

a developing magnet roll provided with a developing bias;

patch forming means for selecting voltage application conditions to said charge means and said developing magnet roll so as to reverse the bias potential relationship between said developing magnet roll and a charge potential of the image carrier and forming a first toner patch image at a contrast potential between the charge potential of the image carrier and the bias potential;

toner concentration control means being responsive to a concentration deviation of the first toner patch image from a concentration target value for increasing or decreasing a toner supply amount for controlling a toner concentration of a developer;

second patch forming means for forming a second toner patch image under the same charging and developing bias potential relationship as normal image forming condition, and output control means for controlling at least one of application voltage to said charge means, light quantity output of exposure means for forming a latent image, and bias potential of said developing magnet roll so as to cancel a concentration deviation of the second toner patch image from the concentration target value;

wherein in an interimage of a print job for forming a plurality of sheets, said second pattern forming means is energized after image formation on a predetermined number of sheets, and wherein said output control means is energized so as to limit a control amount to a predetermined range from an output value at a previous control time.

2. An image forming system adopting a dual-component inversion developing system for forming on an image carrier a toner patch images used for detecting an image concentration and controlling an image forming condition based on the concentration of the toner patch image, said image forming system comprising:

charge means for uniformly charging a surface of the image carrier;

a developing magnet roll provided with a developing bias;

patch forming means for selecting voltage application conditions to said charge means and said developing magnet roll so as to reverse the bias potential relationship between said developing magnet roll and a charge potential of the image carrier and forming a first toner patch image at a contrast potential between the charge potential of the image carrier and the bias potential;

toner concentration control means being responsive to a concentration deviation of the first toner patch image from a concentration target value for increasing or decreasing a toner supply amount for controlling a toner concentration of a developer; and concentration target value correction means for correcting the concentration target value in response to change in a cause affecting the concentration of the first toner patch image.

3. The image forming system as claimed in claim 2, further comprising consumed toner sensing means for sensing that toner has been consumed based on a concentration deviation of the first toner patch image from a concentration target value.

4. The image forming system as claimed in claim 2, further comprising image amount detection means for detecting an image amount based on an exposure time of exposure means for forming a latent image, toner supply control means for determining a toner supply amount in response to the image amount detected by said image amount detection means, and toner supply amount correction means for correcting the toner supply amount calculated by said toner supply control means based on the concentration of the first toner patch image.

5. The image forming system as claimed in claim 2, further comprising a transfer roll for transferring a toner image formed on the image carrier to a medium, wherein when the first toner patch image is formed, voltage application to said transfer roll is stopped.

* * * * *

UNITED STATES PATENT AND TRADEMARK OFFICE

CERTIFICATE OF CORRECTION

PATENT NO. : 6,029,021
DATED : February 22, 2000
INVENTOR(S) : Shigeki Nishimura et al.

It is certified that error appears in the above-identified patent and that said Letters Patent is hereby corrected as shown below:

Column 25, claim 2,
Line 40, "images" should read -- image --.

Signed and Sealed this

Fourth Day of December, 2001

*Attest:*

Nicholas P. Godici

NICHOLAS P. GODICI
*Acting Director of the United States Patent and Trademark Office*

*Attesting Officer*